US009437129B2

(12) United States Patent
Lee et al.

(10) Patent No.: US 9,437,129 B2
(45) Date of Patent: Sep. 6, 2016

(54) DISPLAY DRIVING INTEGRATED CIRCUIT, DISPLAY DEVICE, AND METHOD USED TO PERFORM OPERATION OF DISPLAY DRIVING INTEGRATED CIRCUIT

(71) Applicants: Young-hun Lee, Seoul (KR); Sun-ik Lee, Hwaseong-si (KR); Young-min Choi, Yongin-si (KR)

(72) Inventors: Young-hun Lee, Seoul (KR); Sun-ik Lee, Hwaseong-si (KR); Young-min Choi, Yongin-si (KR)

(73) Assignee: SAMSUNG ELECTRONICS CO., LTD., Gyeonggi-Do (KR)

( * ) Notice: Subject to any disclaimer, the term of this patent is extended or adjusted under 35 U.S.C. 154(b) by 24 days.

(21) Appl. No.: 14/601,339

(22) Filed: Jan. 21, 2015

(65) Prior Publication Data

US 2015/0213751 A1 Jul. 30, 2015

(30) Foreign Application Priority Data

Jan. 29, 2014 (KR) ..... 10-2014-0011524

(51) Int. Cl.

| | |
|---|---|
| ***G09G 5/00*** | (2006.01) |
| ***G09G 3/20*** | (2006.01) |
| ***G09G 3/36*** | (2006.01) |

(52) U.S. Cl.

CPC ..... *G09G 3/2085* (2013.01); *G09G 3/2096* (2013.01); *G09G 3/3688* (2013.01); *G09G 2310/0286* (2013.01); *G09G 2310/08* (2013.01); *G09G 2330/021* (2013.01); *G09G 2330/06* (2013.01)

(58) Field of Classification Search

CPC ..... G09G 3/2085; G09G 3/2092; G09G 3/2096; G09G 3/3648; G09G 3/3685; G09G 3/3688; G09G 5/18; G09G 2310/08; G09G 2330/021; G09G 2330/06

See application file for complete search history.

(56) References Cited

U.S. PATENT DOCUMENTS

| | | | | |
|---|---|---|---|---|
| 6,348,915 | B1 | 2/2002 | Yamashita et al. | |
| 7,242,766 | B1 * | 7/2007 | Lyle | H04L 9/12 380/2 |
| 7,307,613 | B2 | 12/2007 | Teshirogi et al. | |
| 7,382,345 | B2 | 6/2008 | Hong | |
| 7,570,256 | B2 | 8/2009 | Han | |

(Continued)

FOREIGN PATENT DOCUMENTS

| | | |
|---|---|---|
| JP | 08-304763 | 11/1996 |
| JP | 2005-181669 A | 7/2005 |

(Continued)

*Primary Examiner* — Joe H Cheng

(74) *Attorney, Agent, or Firm* — Harness, Dickey & Pierce, P.L.C.

(57) ABSTRACT

Provided are display driving integrated circuits, display devices, and/or methods of operating the display driving integrated circuit. The display driving integrated circuit including a timing controller processing input data and outputting output data; and a source driving unit including at least one source driver and converting into analog data the output data received through a transmission channel connected to the timing controller and outputting the analog data as display data may be provided. The timing controller may include a data selecting unit comparing a transition count of the input data with a transition count of encoded data obtained by encoding the input data, and outputting one of the input data and the encoded data as selection data according to the comparison, a data randomizing unit randomizing the selection data and generating random data, and a data transmitting unit converting the random data into the output data may be provided.

20 Claims, 24 Drawing Sheets

(56) References Cited

U.S. PATENT DOCUMENTS

| | | | | |
|---|---|---|---|---|
| 7,676,528 | B2 | 3/2010 | Okumura et al. | |
| 7,688,108 | B2 | 3/2010 | Hong et al. | |
| 7,961,163 | B2 | 6/2011 | Koo et al. | |
| 8,232,938 | B2 | 7/2012 | Kohno | |
| 2007/0120953 | A1* | 5/2007 | Koga | H04B 3/54 348/14.01 |
| 2012/0072799 | A1 | 3/2012 | Ishioka | |
| 2013/0058580 | A1* | 3/2013 | Wakazono | G06T 11/00 382/201 |
| 2015/0103957 | A1* | 4/2015 | Agar | H04L 27/14 375/334 |

FOREIGN PATENT DOCUMENTS

| | | | |
|---|---|---|---|
| JP | 2010-210693 | A | 9/2010 |
| KR | 10-2008-0057456 | | 6/2008 |
| KR | 10-0897163 | B1 | 5/2009 |
| KR | 10-2009-0116968 | | 11/2009 |
| KR | 10-1001999 | B1 | 12/2010 |

* cited by examiner

DISPLAY DRIVING INTEGRATED CIRCUIT, DISPLAY DEVICE, AND METHOD USED TO PERFORM OPERATION OF DISPLAY DRIVING INTEGRATED CIRCUIT

CROSS-REFERENCE TO RELATED APPLICATIONS

This application claims priority to Korean Patent Application No. 10-2014-0011524, filed on Jan. 29, 2014, in the Korean Intellectual Property Office, the disclosure of which is incorporated herein in its entirety by reference.

BACKGROUND

Example embodiments relate to display driving integrated circuits, display devices, and/or methods used to perform operations of the display driving integrated circuits, and more particularly, to display driving integrated circuits, display devices, and/or methods used to perform operations of the display driving integrated circuits which may reduce power consumption and/or may attenuate electromagnetic interference (EMI).

A frequency used to drive a display device has increased as demand for the display device having a high resolution has increased. Accordingly, the display device or a display driving integrated circuit suffers from problems, for example, increased power consumption and increased EMI.

SUMMARY

Some example embodiments provide display driving integrated circuits, display devices, and/or methods used to perform operations of the display driving integrated circuits, which may reduce power consumption.

Some example embodiments provide display driving integrated circuits, display devices, and/or methods used to perform operations of the display driving integrated circuits, which may attenuate electromagnetic interference (EMI).

According to an example embodiment, a display driving integrated circuit may include a timing controller configured to process input data and output data, the timing controller including a data selecting unit configured to compare a transition count of the input data with a transition count of encoded data obtained by encoding the input data, and output one of the input data and the encoded data as selection data according to a comparison result, a data randomizing unit configured to randomize the selection data and generate random data, and a data transmitting unit configured to convert the random data into the output data, and a source driving unit including at least one source driver, the at least one source driver configured to convert the output data received through a transmission channel connected to the timing controller into analog data and output the analog data as display data.

In some example embodiments, The data selecting unit may include a data input unit configured to receive the input data, a first transition calculating unit configured to calculate the transition count of the input data as a first value, a data encoding unit configured to generated the encoded data by encoding the input data, a second transition calculating unit configured to calculate the transition count of the encoded data as a second value, a comparison unit configured to compare the first value with the second value and outputs the comparison result, and a data output unit configured to output one of the input data and the encoded data according to the comparison result.

In some example embodiments, the data encoding unit may be configured to generate the encoded data by encoding first pixel data through Mth pixel data of the input data such that the encoded data includes the first pixel data and differences between adjacent pieces of pixel data from among the first pixel data through the Mth pixel data of the input data.

In some example embodiments, the input data may include first pixel data through Mth pixel data, each of the first pixel data through the Mth pixel data of the input data may include first sub-pixel data through Nth sub-pixel data, and the data encoding unit is configured to generate the encoded data by encoding the first sub-pixel data through M*Nth sub-pixel data of the input data such that the encoded data includes the first sub-pixel data and differences between adjacent pieces of sub-pixel data from among the first sub-pixel data through M*Nth sub-pixel data of the input data.

In some example embodiments, the first transition calculating unit may be configured to calculate the first value obtained by counting a number of 1s in first pixel data of the input data, by counting a number of 1s in values obtained by performing an XOR operation on adjacent pieces of pixel data from among the first pixel data through Mth pixel data of the input data, and by summing the counted numbers of 1s, and the second transition calculating unit may be configured to, in response to a first control signal, calculate the second value by counting a number of 1s in first pixel data of the encoded data, by counting a number of 1s in values obtained by performing an XOR operation on adjacent pieces of pixel data from among the first pixel data through Mth pixel data of the encoded data, and by summing the counted number of 1s.

In some example embodiments, the data randomizing unit may include a scrambler configured to perform an XOR operation on the selection data and a random pattern, and generate the random data; and a pattern generating unit configured to transmit the random pattern to the scrambler.

In some example embodiments, the pattern generating unit may be a linear feedback shift register (LFSR).

In some example embodiments, in response to a second control signal, the pattern generating unit may be configured to generate the random pattern in a first cycle corresponding to a size of a horizontal line of a frame of a display panel, which is driven by the display driving integrated circuit.

In some example embodiments, in response to a second control signal, the pattern generating unit may be configured to generate the random pattern in a second cycle corresponding to a size of a frame of a display panel, which is driven by the display driving integrated circuit.

In some example embodiments, the source driving unit may include x source drivers, and the random pattern has one logic value corresponding to every 1/x of a size of a horizontal line of a frame of a display panel, which is driven by the display driving integrated circuit.

In some example embodiments, the data randomizing unit may be configured to directly pass the selection data to the data transmitting unit in response to a third control signal, and the data transmitting unit may be configured to convert the directly passed selection data into the output data.

In some example embodiments, the output data may include first mode information indicating the comparison result, and the source driving unit may be configured to inversely convert the output data according to the first mode information.

In some example embodiments, the output data may further include at least one of information about an encoding method performed on the encoded data, information about a cycle of a random pattern of the random data, and information about whether to generate the random data, and the source driving unit may be configured to inversely convert the output data according to the first mode information and the at least one information.

In some example embodiments, the data transmitting unit may include: a serial converter configured to serialize the random data into serial data, and a data packetizing unit configured to packetize the serial data and generate the output data to the transmission channel.

In some example embodiments, the source driving unit may include x source drivers, and the data transmitting unit further includes a clock embedding unit, the clock embedding unit configured to embed a clock signal into the serial data corresponding to every 1/x of a size of a horizontal line of a frame of a display panel, which is driven by the display driving integrated circuit.

In some example embodiments, the source driving unit may include x source drivers and a plurality of transmission channels including the transmission channel, and the transmission channel is connected to the timing controller and each of the x source drivers are connected in a point-to-point manner through the plurality of transmission channels.

In some example embodiments, the timing controller may be configured to transmit the output data to the source driving unit via an enhanced reduced voltage differential signaling (eRVDS) interface.

In some example embodiments, the source driving unit may include x source drivers, and the data selecting unit may be configured to generate the encoded data by encoding, using different methods, with respect to at least one portion of the input data corresponding to at least one of the x source drivers and other portions of the input data.

According to another example embodiment, a display driving integrated circuit may include a timing controller configured to process input data having a size corresponding to a horizontal line of a frame of a display panel and generate x pieces of output data, the timing controller including a data selecting unit configured to compare a transition count of the input data with a transition count of encoded data obtained by encoding the input data, and output one of the input data and the encoded data as selection data according to a comparison result, a data randomizing unit configured to randomize the selection data and generate random data, and a data transmitting unit configured to embed a clock signal into the random data for every 1/x of the random data, convert the clock signal embedded clock random data into the x pieces of output data, and transmit the x pieces of output data to the x source drivers, and x source drivers, each configured to convert into analog data a corresponding one of the x pieces of output data received through a corresponding one of a plurality of transmission channels, which are connected to the timing controller.

In some example embodiments, the data randomizing unit may be configured to generate the random data by using a random pattern having one logic value for every x pieces of output data.

In some example embodiments, the clock signal may be configured to have a value obtained by inverting a logic value of a last bit of the random data that is embedded for every 1/x, which immediately precedes the clock signal.

In some example embodiments, the data selecting unit may be configured to generate the encoded data by encoding, using different methods, with respect to at least one portion of the input data corresponding to at least one of the x source drivers and other portions of the input data.

According to an example embodiment, a display device may include a display panel configured to display data, and a display driving integrated circuit configured to process input data having a size corresponding to a horizontal line of a frame of the display panel and convert the input data into the display data, the display driving integrated circuit including a timing controller configured to compare a transition count of the input data with a transition count of encoded data obtained by encoding the input data, randomizes data having a less transition count from among the input data and the encoded data, and output data, and a source driving unit including x source drivers, each of the x source drivers configured to convert the output data received through a transmission channel connected to the timing controller into analog data and transmit the analog data as the display data.

In some example embodiments, the timing controller may be configured to embed a clock signal for every 1/x of the input data and outputs the output data, and may be configured to perform the randomization by using a random pattern having one logic value for every 1/x of the input data.

According to an example embodiment, a method of operating a display driving integrated circuit including a timing controller configured to process input data and generate output data, and a source driving unit having at least one source driver and configured to converts into analog data the output data received through a transmission channel connected to the timing controller and output the analog data as display data, the method including: comparing a transition count of the input data with a transition count of encoded data obtained by encoding the input data, and outputting one of the input data and the encoded data as selection data according to a comparison result, randomizing the selection data and generating random data, and converting the random data into the output data and transmitting the output data to the source driving unit.

According to an example embodiment, a timing controller of a display driving integrated circuit may include a data selecting unit configured to generate selection data from input data and encoded data based on a first transition count of the input data and a second transition count of the encoded data, the encoded data being obtained by encoding the input data, the first transition count being a count of transitions in the input data; the second transition count being a count of transitions in the encoded data, and a data randomizing unit configured to randomize the selection data and generate random data.

The timing controller may be configured to randomize data having a less transition count from among the input data and the encoded data.

In some example embodiments, the data selecting unit may include a first transition calculating unit configured to calculate the first transition count of the input data, a data encoding unit configured to generate the encoded data by encoding the input data, a second transition calculating unit configured to calculate the second transition count of the encoded data, and a data output unit configured to output one of the input data and the encoded data according to the first and second transition counts.

In some example embodiments, the data selecting unit may further include a comparison unit configured to compare the first transition count of the input data with the second transition count of the encoded data.

In some example embodiments, the data randomizing unit may include a pattern generating unit configured to transmit a random pattern to the scrambler and a scrambler configured to perform a logic operation on the selection data and the random pattern received from the pattern generating unit, and generate the random data.

In some example embodiments, the data randomizing unit may include a cycle mode selecting unit, the cycle mode selecting unit configured to output mode information indicating a cycle of a random pattern in response to a control signal and the control signal is configured to set a cycle to select a degree of randomization.

In some example embodiments, the data randomizing unit may include a randomizing mode selecting unit, the randomizing mode selecting unit configured to, in response to a control signal, output mode information indicating whether to perform the randomizing.

BRIEF DESCRIPTION OF THE DRAWINGS

Example embodiments of the inventive concepts will be more clearly understood from the following detailed description taken in conjunction with the accompanying drawings in which.

DETAILED DESCRIPTION OF EXAMPLE EMBODIMENTS

Figure 1:
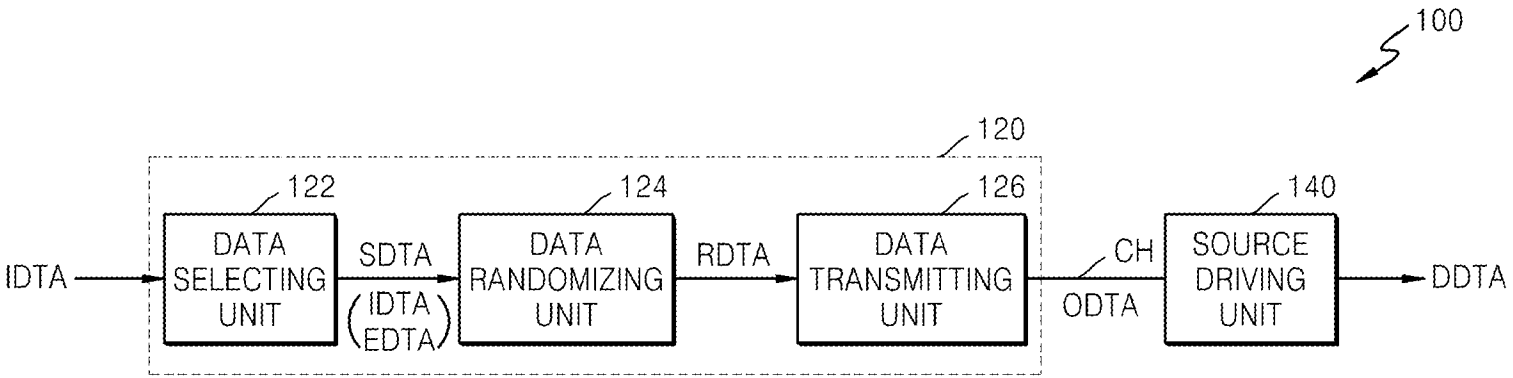
FIG. 1 is a block diagram of a display driving integrated circuit according to an example embodiment of the inventive concepts.

Various example embodiments will be described more fully hereinafter with reference to the accompanying drawings, in which some example embodiments are shown. The present disclosure may, however, be embodied in many different forms and should not be construed as limited to the example embodiments set forth herein. Rather, these example embodiments are merely provided so that this disclosure will be thorough and complete, and will fully convey the scope of example embodiments to those skilled in the art. In the drawings, the sizes and relative sizes of the various layers and regions may have been exaggerated for clarity. Like numerals refer to like elements throughout.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. As used herein, the term "and/or" includes any and all combinations of one or more of the associated listed items. Expressions such as "at least one of," when preceding a list of elements, modify the entire list of elements and do not modify the individual elements of the list.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of example embodiments.

The terms used in the present specification are merely used to describe particular example embodiments, and are not intended to limit the inventive concepts. As used herein, the singular forms "a," "an" and "the" are intended to encompass the plural forms as well, unless it has a clearly different meaning in the context. In the present specification, it is to be understood that the terms such as "including", "having", and "comprising" are intended to indicate the existence of the features, numbers, steps, actions, components, parts, or combinations thereof disclosed in the specification, and are not intended to preclude the presence or addition of one or more other features, numbers, steps, actions, components, parts, or combinations thereof.

Meanwhile, when it is possible to implement any embodiment in any other way, a function or an operation specified in a specific block may be performed differently from a flow specified in a flowchart. For example, two consecutive blocks may actually perform the function or the operation simultaneously, and the two blocks may perform the function or the operation conversely according to a related operation or function.

All terms including technical and scientific terms used herein have meanings which can be generally understood by those of ordinary skill in the art, if the terms are not particularly defined. General terms defined by dictionaries should be understood to have meanings which can be contextually understood in the art and should not have ideally or excessively formal meanings, if the terms are not defined particularly herein by the inventive concepts.

Hereinafter, some example embodiments will be explained in further detail with reference to the accompanying drawings.

FIG. 1 is a block diagram of a display driving integrated circuit 100 according to an example embodiment of the inventive concepts. Referring to FIG. 1, the display driving integrated circuit 100 includes a timing controller 120 and a source driving unit 140. The timing controller 120 processes input data IDTA and output data ODTA. The timing controller 120 includes a data selecting unit 122, a data randomizing unit 124, and a data transmitting unit 126.

The data selecting unit 122 may select one of the input data IDTA and encoded data EDTA as selection data SDTA. The data selecting unit 122 may compare transition counts of the input data IDTA and the encoded data EDTA, and select the selection data SDTA. The selection data SDTA is transmitted to the data randomizing unit 124. The data randomizing unit 124 randomizes the selection data SDTA and generates random data RDTA. The data transmitting unit 126 converts the random data RDTA into the output data ODTA. Operations of the data selecting unit 122, the data randomizing unit 124, and the data transmitting unit 126 will be explained in detail below.

The source driving unit 140 may convert the output data ODTA, which is transmitted through a transmission channel CH connected to the timing controller 120, into analog data and output the analog data as display data DDTA.

Figure 2:
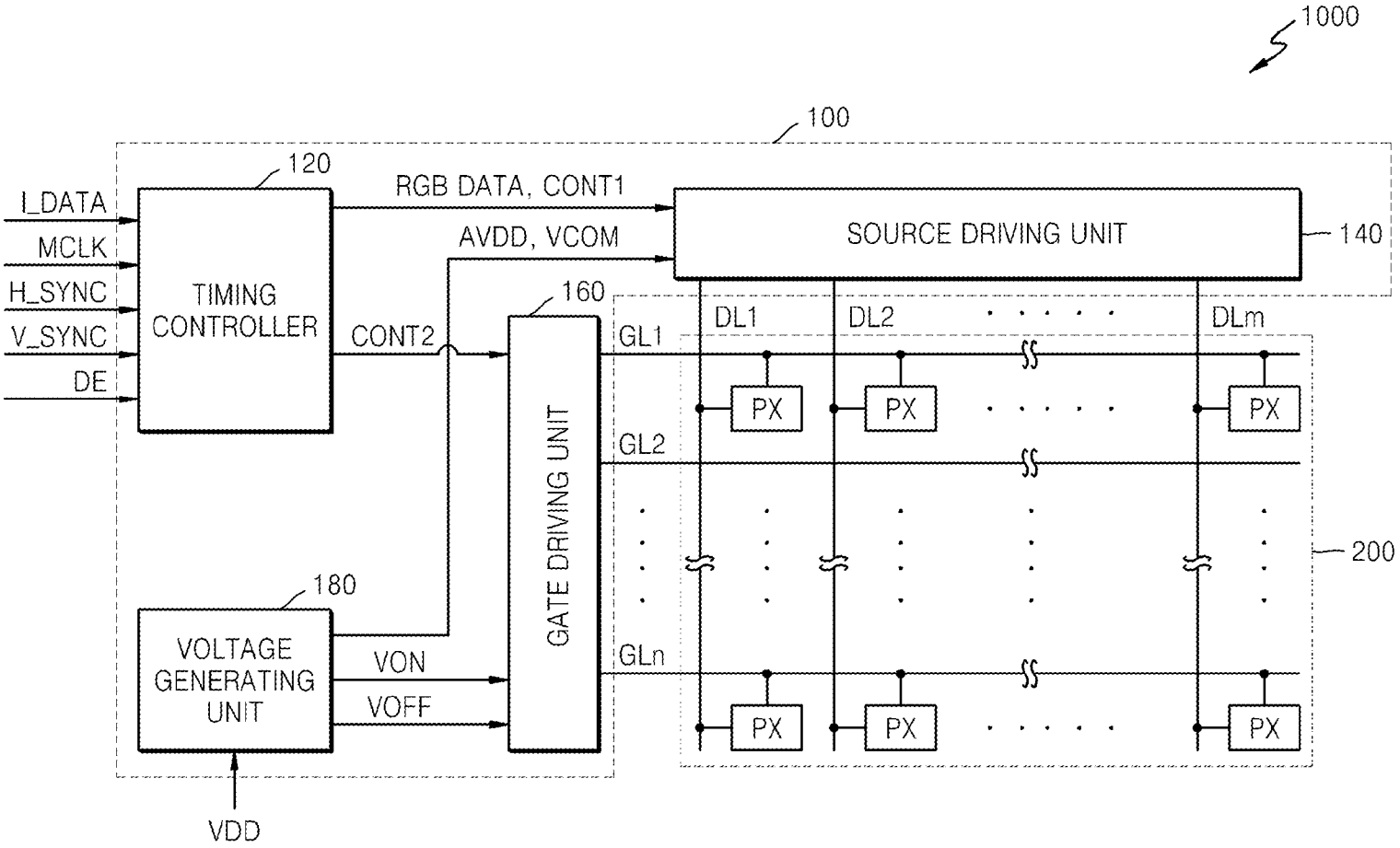
FIG. 2 is a block diagram of a display device including the display driving integrated circuit of FIG. 1, according to an example embodiment of the inventive concepts.

The display driving integrated circuit 100 of FIG. 1 may be included in a display device. FIG. 2 is a block diagram of a display device 1000 including the display driving integrated circuit 100 of FIG. 1, according to an example embodiment of the inventive concepts.

Referring to FIG. 2, the display device 1000 may include a display panel 200 for displaying an image (display data), and the display driving integrated circuit 100 for driving the display panel 200. The display driving integrated circuit 100 may include the timing controller 120 and the source driving unit 140 as illustrated in FIG. 1. The display driving integrated circuit 100 may further include a gate driving unit 160 and a voltage generating unit 180. The source driving unit 140 and the gate driving unit 160 may respectively include at least one source driver and at least one gate driver. Hereinafter, operations of the source driving unit 140 and the gate driving unit 160 and operations of the at least one source driver and the at least one gate driver may be interchangeably explained.

The timing controller 120 may generate various timing signals or data, for example, pixel data RGB DATA, a first timing control signal CONT1, and a second timing control signal CONT2, for driving the source driving unit 140 and the gate driving unit 160. The pixel data RGB DATA that is transmitted by the timing controller 120 to the source driving unit 140 may be the display data DDTA of FIG. 1. The timing controller 120 may receive, for example, external data I_DATA, a horizontal synchronization signal H_SYNC, a vertical synchronization signal V_SYNC, a clock signal MCLK, and a data enable signal DE from an external device (for example, a host device (not shown)). The external data I_DATA may be the input data IDTA of FIG. 1.

The timing controller 120 may generate the pixel data RGB DATA by changing a format of the external data I_DATA in order to interface with the source driving unit 140 and transmit the pixel data RGB DATA to the source driving unit 140. Further, the timing controller 120 may output at least one first timing control signal CONT1 to the source driving unit 140 and output at least one second timing control signal CONT2 to the gate driving unit 160 based on the horizontal synchronization signal H_SYNC, the vertical synchronization signal V_SYNC, the clock signal MCLK, and the data enable signal DE in order to control timings of the source driving unit 140 and the gate driving unit 160.

Figure 3:
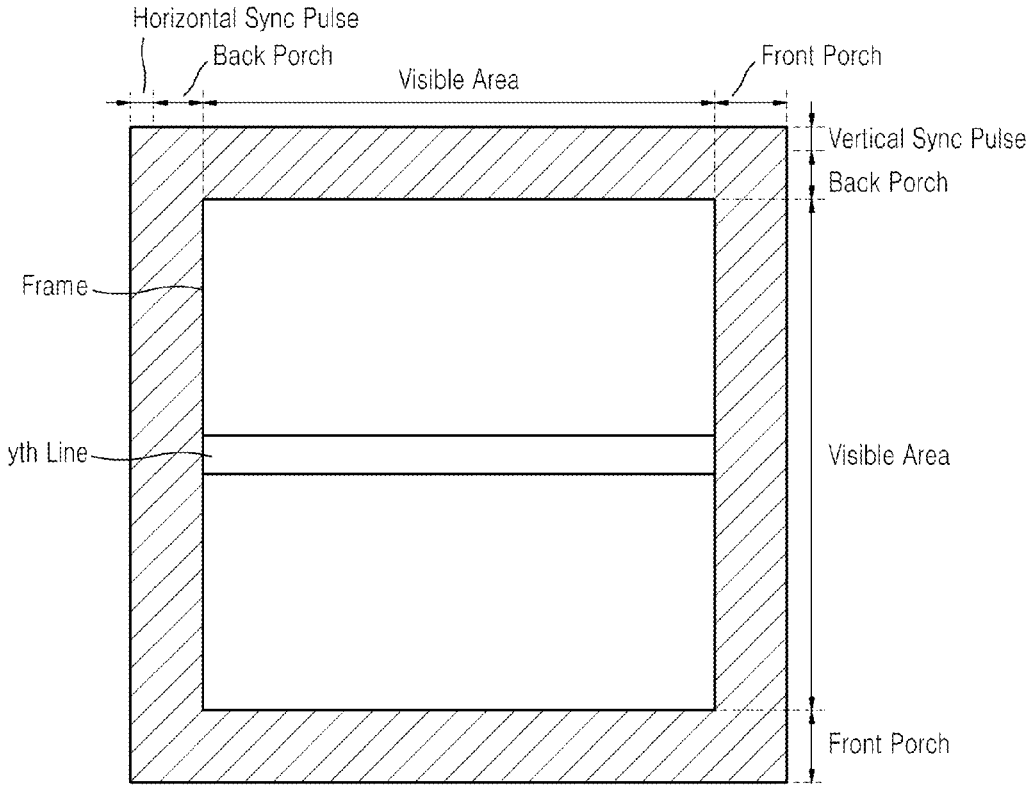
FIG. 3 is a diagram illustrating timing control signals for a display panel of FIG. 2, according to an example embodiment of the inventive concepts.

FIG. 3 is a diagram illustrating timing control signals for the display panel 200 of FIG. 2, according to an example embodiment of the inventive concepts. Referring to FIG. 3, the display panel 200 may be, for example, a liquid crystal display (LCD) panel. Data displayed in a visible area on the display panel 200 may be referred to as a frame. For example, when the display panel 200 is driven at 60 Hz, 60 frames per second are displayed on the display panel 200. Each frame may include a horizontal line (for example, a yth line) in a horizontal direction.

The first timing control signal CONT1 and the second timing control signal CONT2 may adjust a timing in order for the frame to be accurately displayed in the visible area. For example, each of the first timing control signal CONT1 and the second timing control signal CONT2 may be a horizontal synchronization pulse, a vertical synchronization pulse, a front porch, or a back porch.

A plurality of horizontal synchronization pulses may be applied to a plurality of horizontal lines, respectively. When a display operation for all horizontal lines of one frame is performed, a vertical synchronization pulse may be applied and a new frame may be displayed. Further, a front porch and/or a back porch may act as a margin. For example, in order to display one horizontal line, a horizontal synchronization pulse having one clock signal length may be applied to the display panel 200, an arbitrary number of clock signals corresponding to a back porch may be applied, and then data corresponding to a horizontal line may be displayed. When a display operation for one horizontal line is completed, an arbitrary number of clock signals corresponding to a front porch may be applied, and then a horizontal synchronization pulse for a next horizontal line may be applied.

Referring back to FIG. 2, the source driving unit 140 receives the first timing control signal CONT1 or the pixel data RGB DATA from the timing controller 120 and drives data lines DL1 through DLm of the display panel 200. The gate driving unit 160 receives the second timing control signal CONT2 from the timing controller 120 and drives gate lines GL1 through GLn of the display panel 200.

The voltage generating unit 180 may generate various voltages, for example, a gate on voltage VON, a gate off voltage VOFF, an analog power voltage AVDD, and a common voltage VCOM, to drive the display panel 200. For example, the voltage generating unit 180 may receive a power voltage VDD from the outside, may generate the gate on voltage VON and the gate off voltage VOFF and apply the gate on voltage VON and the gate off voltage VOFF to the gate driving unit 160, and may generate the analog power voltage AVDD and the common voltage VCOM and apply the analog power voltage AVDD and the common voltage VCOM to the source driving unit 140.

The display device 1000 may be any of various flat panel display devices. For example, a flat panel display device may include an LCD device, an organic electroluminescent (EL) display device, and a plasma display panel (PDP). A flat panel display device may be a hybrid flat panel display device that may sense a physical touch or an optical touch. The display device 1000 may be, for example, the hybrid flat panel display device. For convenience of explanation, the following description will be explained assuming that the display device 1000 is an LCD device.

The display panel 200 may include the plurality of gate lines GL1 through GLn, the plurality of data lines DL1 through DLm that intersect the gate lines GL1 through GLn, and pixels PX that are arranged at intersection points between the gate lines GL1 through GLn and the data lines DL1 through DLm. When the display device 1000 is a thin-film transistor (TFT) LCD device, each of the pixels PX may include a TFT that includes a gate electrode and a source electrode respectively connected to the gate lines GL1 through GLn and the data lines DL1 through DLm, and a liquid crystal capacitor (not shown) and a storage capacitor (not shown) that are connected to a drain electrode of the TFT.

In this structure, when a gate line is selected, a TFT of a pixel connected to the selected gate line is turned on, and then a data signal, including pixel information, may be applied to each data line by the source driving unit 140. The data signal (for example, the display data DDTA of FIG. 1) may be applied through the TFT of the pixel to a liquid crystal capacitor and a storage capacitor, and a display operation may be performed by driving the liquid crystal and storage capacitors.

As the number of pixels PX of the display panel 200 that is driven by the display driving integrated circuit 100 increases, the source driving unit 140 may include a plurality of source drivers, and each of the source drivers may drive a source line of a corresponding area of the display panel 200.

Figure 4:
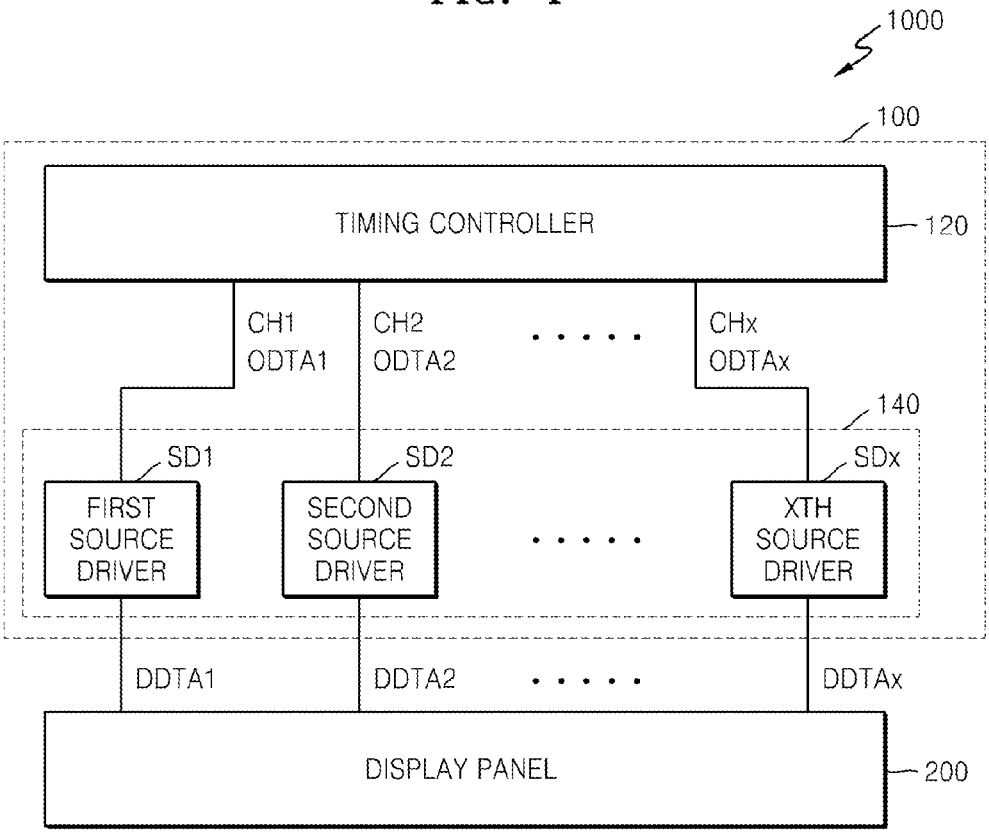
FIG. 4 is a block diagram of a display device including a source driving unit of FIG. 1, according to an example embodiment of the inventive concepts.

FIG. 4 is a block diagram of a display device 1000 including the source driving unit 140 of FIG. 1, according to an example embodiment of the inventive concepts. Referring to FIG. 4, the source driving unit 140 may include x (x is a positive integer equal to or greater than 2) source drivers, that is, first through xth source drivers SD1, SD2, . . . , and SDx. Each of the first through xth source drivers SD1, SD2, . . . , and SDx may perform a function of the source driving unit 140. For example, in order to transmit the display data DDTA to the display panel 200, the first through xth source drivers SD1, SD2, . . . , and SDx may respectively receive first through xth pieces of output data ODTA1, ODTA2, . . . , and ODTAx from the timing controller 120, may decode the received first through xth pieces of output data ODTA1, ODTA2, . . . , and ODTAx into analog voltages, may select one grayscale voltage from among a plurality of grayscale voltages according to a result of the decoding, and may apply the selected grayscale voltage as first through xth pieces of display data DDTA1, DDTA2, . . . , and DDTAx to the display panel 200.

Each of the first through xth source drivers SD1, SD2, . . . , and SDx may be connected to the timing controller 120 in a point-to-point manner. For example, the first source driver SD1 may be connected to the timing controller 120 through a first transmission channel CH1, and the second source driver SD2 may be connected to the timing controller 120 through a second transmission channel CH2. Likewise, the xth source driver SDx may be connected to the timing controller 120 through an xth transmission channel CHx. Although not shown in FIG. 4, some or all of the first and second timing control signals CONT1 and CONT2 of FIG. 2 may be provided separately from the first through xth transmission channels CH1, CH2, . . . , and CHx, and may be connected to the first through xth source drivers SD1, SD2, . . . , and SDx through another channel that are connected to all of the first through xth source drivers SD1, SD2, . . . , and SDx.

The first through xth source drivers SD1, SD2, . . . , and SDx respectively receive the first through xth pieces of output data ODTA1, ODTA2, . . . , and ODTAx that are applied through the first through xth transmission channels CH1, CH2, . . . , and CHx. For example, the first source driver SD1 may receive the first output data ODTA1 that is applied through the first transmission channel CH1, and the second source driver SD2 may receive the second output data ODTA2 that is applied through the second transmission channel CH2. Likewise, the xth source driver SDx may receive the xth output data ODTAx that is applied through the xth transmission channel CHx. As described above, the first through xth pieces of output data ODTA1, ODTA2, . . . , and ODTAx may be data obtained after the timing controller 120 processes the input data IDTA. The input data IDTA and the first through xth pieces of output data ODTA1, ODTA2, . . . , and ODTAx may be conceptually illustrated as in FIGS. 5 and 6.

Figure 5:
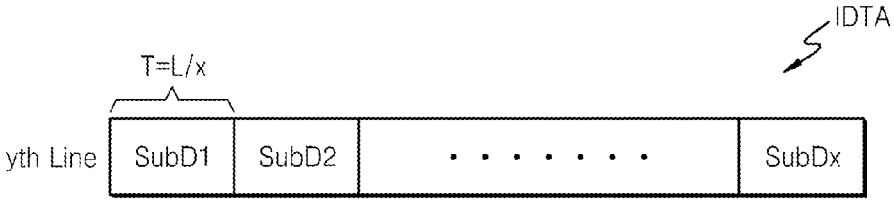
FIG. 5 is a conceptual diagram illustrating input data according to an example embodiment of the inventive concepts.
Figure 6:
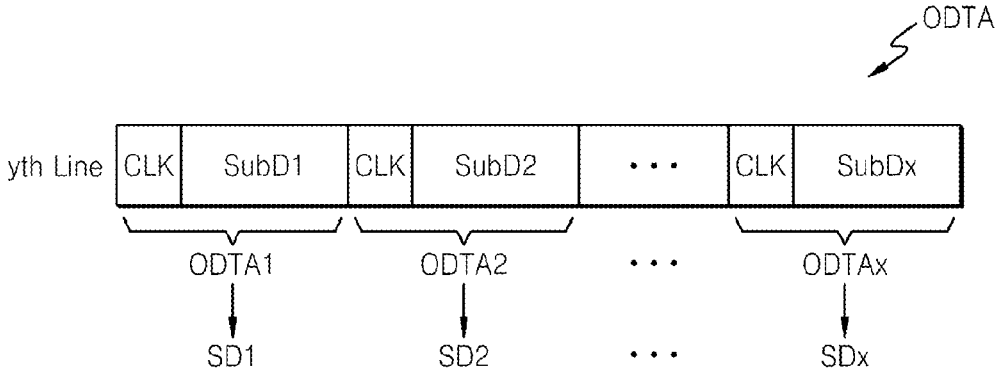
FIG. 6 is a conceptual diagram illustrating output data according to an example embodiment of the inventive concepts.

FIG. 5 is a conceptual diagram illustrating the input data IDTA according to an example embodiment of the inventive concepts. FIG. 6 is a conceptual diagram illustrating the first through xth pieces of output data ODTA1, ODTA2, . . . , and ODTAx according to an example embodiment of the inventive concepts. Referring to FIG. 5, the input data IDTA may be input with a size corresponding to a horizontal line (a gate line) of the display panel 200 of FIGS. 2 through 4. For example, the input data IDTA may be input with the same size L as that of the horizontal line (for example, the yth line of the frame of FIG. 3) of the display panel 200.

In this case, when the source driving unit 140 includes the first through xth source drivers SD1, SD2, . . . , and SDx, the first through xth source drivers SD1, SD2, . . . , and SDx may respectively receive the first through xth pieces of output data ODTA1, ODTA2, . . . , and ODTAx of FIG. 6 that correspond to a unit T (where T=L/x) obtained by dividing the input data IDTA by x. The timing controller 120 of FIG. 1 or 4 may embed a clock signal CLK for each x piece of sub-data, that is, first through xth pieces of sub-data SubD1, SubD2, . . . , and SubDx, which are obtained by dividing the input data IDTA by x. For example, when the unit obtained by dividing the input data IDTA by x may include the first sub-data SubD1, the second sub-data SubD2, . . . , and the xth sub-data SubDx, the clock signal CLK may be included in each of the first sub-data SubD1, the second sub-data SubD2, . . . , and the xth sub-data SubDx. For example, the first sub-data SubD1 and the clock signal CLK for the first sub-data SubD1 may be transmitted as the first output data ODTA1 to the first source driver SD1, and the second sub-data SubD2 and the clock signal CLK for the second sub-data SubD2 may be transmitted as the second output data ODTA2 to the second source driver SD2. Likewise, the xth sub-data SubDx and the clock signal CLK for the xth sub-data SubDx may be transmitted as the xth output data ODTAx to the xth source driver SDx. Further, each of the first output data ODTA1 through the xth output data ODTAx may include a header, which will be explained below.

Referring back to FIG. 4, the first through xth source drivers SD1, SD2, . . . , and SDx may respectively process the received first through xth pieces of output data ODTA1, ODTA2, . . . , and ODTAx and may output the display data DDTA. For example, the first source driver SD1 may process the first output data ODTA1 applied through the first transmission channel CH1 and output the first display data DDTA1, and the second source driver SD2 may process the second output data ODTA2 applied through the second transmission channel CH2 and output the second display data DDTA. Likewise, the xth source driver SDx may process the xth output data ODTAx applied through the xth transmission channel CHx and output the xth display data DDTAx. As described above, each of the first through xth source drivers SD1, SD2, . . . , and SDx may drive a corresponding area of the frame of the display panel 200 of FIG. 3. For example, the first source driver SD1 may display the first display data DDTA1 in a first area that is obtained by dividing the horizontal line by x, and the second source driver SD2 may display the second display data DDTA2 in a second area that is obtained by dividing the horizontal line by x. Likewise, the xth source driver SDx may display the xth display data DDTAx in a last area that is obtained by dividing the horizontal line by x.

Figure 7:
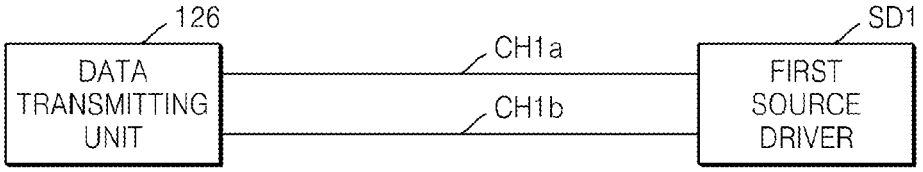
FIG. 7 is a block diagram of an interface between a timing controller and a source driving unit, according to an example embodiment of the inventive concepts.

FIG. 7 is a block diagram of an interface between the timing controller 120 and the source driving unit 140, according to an example embodiment of the inventive concepts. As described above, the first through xth source drivers SD1, SD2, . . . , and SDx may be connected to the timing controller 120 in a point-to-point manner through the first through xth transmission channels CH1, CH2, . . . , and CHx. For example, the first through xth pieces of output data ODTA1, ODTA2, . . . , and ODTAx each including the clock signal CLK may be respectively transmitted through the first through xth transmission channels CH1, CH2, . . . , and CHx to the first through xth source drivers SD1, SD2, . . . , and SDx. For example, the data transmitting unit 126 of the timing controller 120 and the first through xth source drivers SD1, SD2, . . . , and SDx may be connected each through two transmission channels CH1a and CH1b and may receive the first through xth pieces of output data ODTA1, ODTA2, . . . , and ODTAx via an enhanced reduced voltage differential signaling (eRVDS) interface.

Although only the first source driver SD1 is illustrated in FIG. 7, the present example embodiment is not limited thereto and any of the other source drivers may be connected through the two transmission channels CH1a and CH1b. Each of the two transmission channels CH1a and CH1b may transmit output data for an adjacent horizontal line. However, the timing controller 120 and the first through xth source drivers SD1, SD2, . . . , and SDx may be connected via an intra panel interface in which a clock signal is embedded, instead of an eRVDS interface. For example, the timing controller 120 and the first through xth source drivers SD1, SD2, . . . , and SDx may be connected via a multi-drop interface.

Referring back to FIG. 1, in order to reduce power consumed by the timing controller 120, the data selecting unit 122 of the display driving integrated circuit 100 may select data having a lesser transition count from among the input data IDTA and the encoded data EDTA that is obtained by encoding the input data IDTA.

Figure 8:
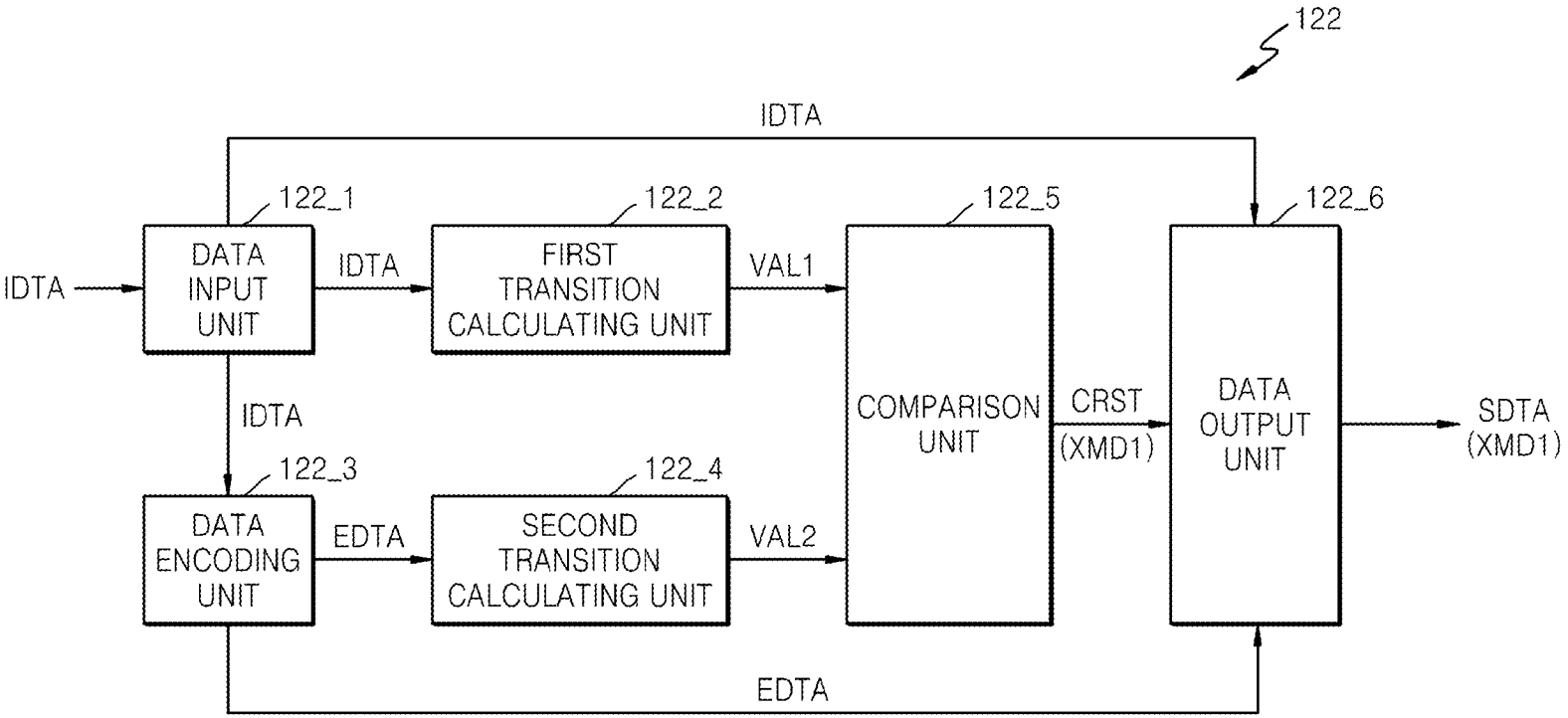
FIG. 8 is a diagram illustrating a data selecting unit of FIG. 1, according to an example embodiment of the inventive concepts.

FIG. 8 is a block diagram of the data selecting unit 122 of FIG. 1, according to an example embodiment of the inventive concepts. Referring to FIG. 8, the data selecting unit 122 may include a data input unit 122_1, a first transition calculating unit 122_2, a data encoding unit 122_3, a second transition calculating unit 122_4, a comparison unit 122_5, and a data output unit 122_6. The input data IDTA may be input to the data input unit 122_1. The first transition calculating unit 122_2 may calculate a transition count of the input data IDTA as a first value VAL1.

Figure 9:
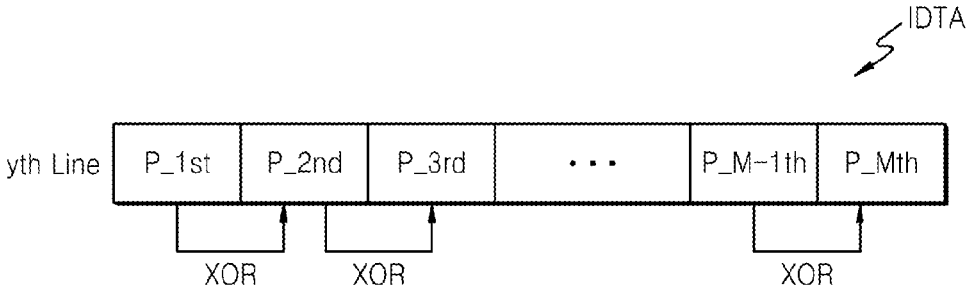
FIG. 9 is a diagram for explaining a method of calculating a transition count in input data, according to an example embodiment of the inventive concepts.

FIG. 9 is a diagram for explaining a method of calculating a transition count in the input data IDTA, according to an example embodiment of the inventive concepts. As described above, the input data IDTA may be input to each horizontal line of a frame, and thus may include pixel data about adjacent pixels in the horizontal line of the frame. In FIG. 9, M pieces of pixel data, that is, first through Mth pieces of pixel data P_1st, P_2nd, . . . , and P_Mth, which are adjacent to each other, may be included in the input data IDTA. A transition count of the input data IDTA may be the number of bits that are bits of adjacent pieces of pixel data of the input data IDTA and have different bit values (e.g., logic values). For example, when a first bit of the first pixel data P_1st and a first bit of the second pixel data P_2nd are different, the first bit may be counted as the transition count. While, when a second bit of the first pixel data P_1st and a second bit of the second pixel data P_2nd are same, the second bit may not be counted as the transition count. The first transition calculating unit 122_2 may calculate a first value VAL1 by counting the number of 1s in values obtained by performing an exclusive OR (XOR) operation on adjacent pieces of pixel data from among the first pixel data P_1st through the Mth pixel data $P_M_{th}$ of the input data IDTA.

For example, the first transition calculating unit 122_2 may count the number of 1s in the first pixel data P_1st, may count the number of 1s in a result obtained by performing an XOR operation on the first pixel data P_1st and the second pixel data P_2nd, and may count the number of 1s in a result obtained by performing an XOR operation on the second pixel data P_2nd and the third pixel data P_3rd. The first transition calculating unit 122_2 may perform an XOR operation on adjacent pieces of pixel data and count the number of 1s in a result of the XOR operation until the XOR operation is performed on the M-1th pixel data P_M-1th and the Mth pixel data P_Mth in the same manner. The first transition calculating unit 122_2 may sum the counted numbers of 1s and may calculate a transition count of the input data IDTA as the first value VAL1.

Figure 10:
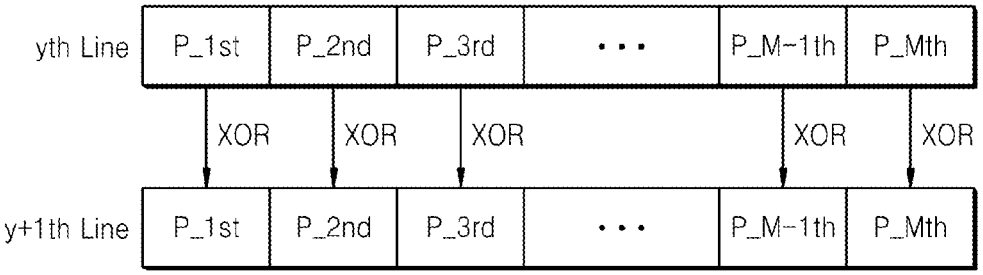
FIG. 10 is a diagram for explaining a method of calculating a transition count in the input data, according to another example embodiment of the inventive concepts.

FIG. 10 is a diagram for explaining a method of calculating a transition count in the input data IDTA, according to another example embodiment of the inventive concepts. Referring to FIGS. 8 and 10, a transition count of the input data IDTA input to each horizontal line of a frame may be the number of bits of pixel data of the input data IDTA corresponding to a horizontal line that have different bit values (e.g., logic values) with respect to pixel data of the input data IDTA corresponding to an adjacent horizontal line. For example, the first transition calculating unit 122_2 may count the number of 1s in a value obtained by performing an XOR operation on the first pixel data P_1st of the input data IDTA for adjacent horizontal lines (e.g., a yth line and a y+1th line), and may count the number of 1s in a value obtained by performing an XOR operation on the second pixel data P_2nd of the input data IDTA for the adjacent horizontal lines (e.g., the yth line and the y+1th line). The first transition calculating unit 122_2 may count the number of 1s in a result obtained by performing an XOR operation on the Mth pixel data P_Mth of the input data IDTA for the adjacent horizontal lines (e.g., the yth line and the y+1th line) in the same manner.

The first transition calculating unit 122_2 may sum the counted numbers of 1 in results obtained by performing an XOR operation on pieces of pixel data of the adjacent horizontal lines (e.g., the yth line and the y+1th line), and may calculate a transition count of the input data IDTA as the first value VAL1. In order to calculate a difference between the adjacent horizontal lines (e.g., the yth line and the y+1th line), as shown in FIG. 10, the data input unit 122_1 of FIG. 8 may have a size that is twice that of the data unit 122_1 of FIG. 9.

Referring back to FIG. 8, the data encoding unit 122_3 may encode the input data IDTA as the encoded data EDTA. The second transition calculating unit 122_4 may calculate a transition count of the encoded data EDTA as the second value VAL2.

Figure 11:
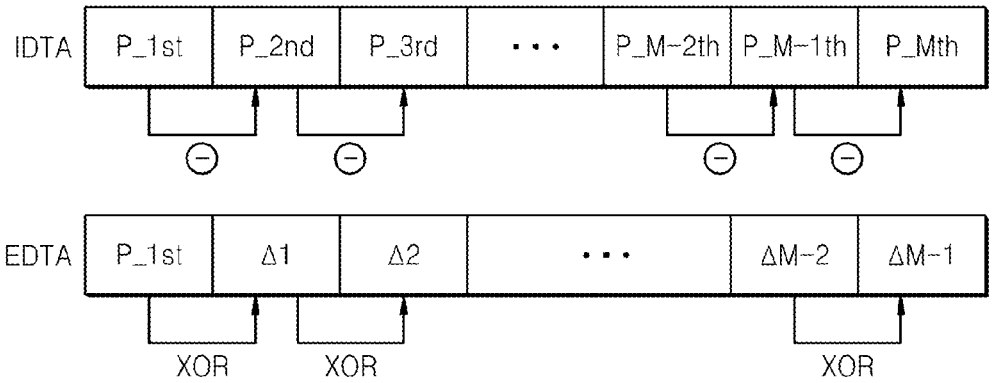
FIG. 11 is a diagram illustrating encoded data to explain a method of calculating a transition count in the encoded data, according to an example embodiment of the inventive concepts.

FIG. 11 is a diagram illustrating the encoded data EDTA to explain a method of calculating a transition count in the encoded data EDTA, according to an example embodiment of the inventive concepts. Referring to FIGS. 8 and 11, the data encoding unit 122_3 may generate the encoded data EDTA by encoding the first pixel data P_1st through the Mth pixel data P_Mth of the input data IDTA to include the first pixel data P_1st of the input data IDTA and differences between adjacent pieces of pixel data from among the first pixel data P_1st through the Mth pixel data P_Mth of the input data IDTA. For example, the encoded data EDTA may be encoded to include the first pixel data P_1st of the input data IDTA, a difference Δ1 between the first pixel data P_1st and the second pixel data P_2nd of the input data IDTA, a difference Δ2 between the second pixel data P_2nd and the third pixel data P_3rd of the input data IDTA, . . . , and a difference ΔM−1 between the M-1th pixel data P_M-1th and the Mth pixel data P_Mth of the input data IDTA. In other words, first pixel data of the encoded data EDTA may be the first pixel data P_1st of the input data IDTA, second pixel data of the encoded data EDTA may be the difference Δ1 between the first pixel data P_1st and the second pixel data P_2nd of the input data IDTA, and third pixel data of the encoded data EDTA may be the difference Δ2 between the second pixel data P_2nd and the third pixel data P_3rd of the input data IDTA. In the same manner, Mth pixel data of the encoded data EDTA may be the difference ΔM−1 between the M-1th pixel data P_M-1th and the Mth pixel data P_Mth of the input data IDTA. In this case, a difference between adjacent pieces of pixel data may be calculated by using, for example, a subtraction, an XOR, or an exclusive NOR (XNOR) operation. The subtraction, XOR, or XNOR operation may be selected in consideration of a size of a circuit for performing the operation.

In this case, the second transition calculating unit 122_4 may count the number of 1s in the first pixel data of the encoded data EDTA, may count the number of 1s in a result obtained by performing, for example, an XOR operation on the first pixel data and the second pixel data of the encoded data EDTA, and may count the number of 1s in a result obtained by performing, for example, an XOR operation on the second pixel data and the third pixel data of the encoded data EDTA. The second transition calculating unit 122_4 may perform, for example, an XOR operation on a difference between adjacent pieces of pixel data of the encoded data EDTA and count the number of 1s in a result of the XOR operation until the XOR operation is performed on the M-1th pixel data and the Mth pixel data of the encoded data EDTA in the same manner. The second transition calculating unit 122_4 may sum the counted numbers of 1 and may calculate a transition count of the encoded data EDTA as the second value VAL2.

Figure 12:
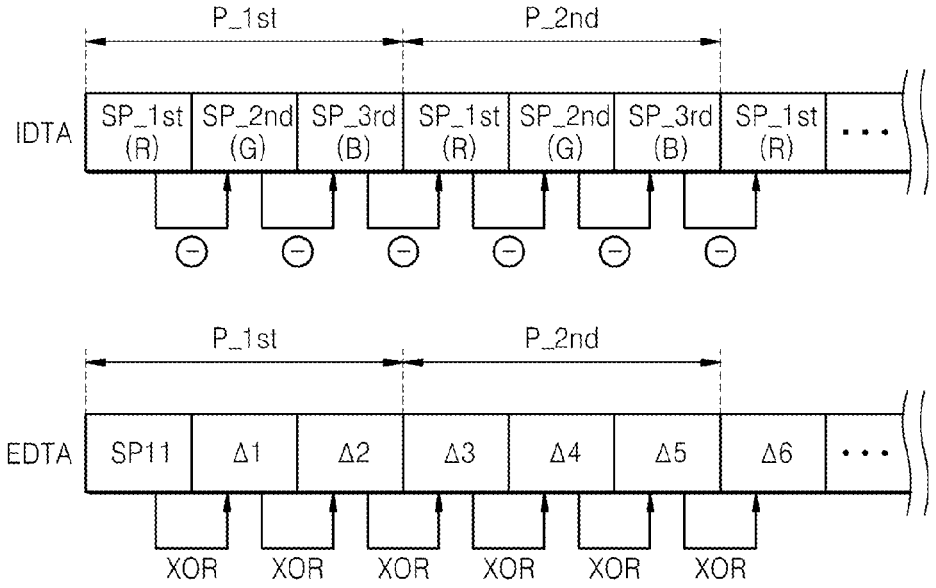
FIG. 12 is a diagram illustrating the encoded data to explain a method of calculating a transition count in the encoded data, according to another example embodiment of the inventive concepts.

FIG. 12 is a diagram illustrating the encoded data EDTA to explain a method of calculating a transition count in the encoded data EDTA, according to another example embodiment of the inventive concepts. Referring to FIGS. 8 and 12, each of the first pixel data P_1st through the Mth pixel data P_Mth of the input data IDTA may include first sub-pixel data SP_1st through Nth sub-pixel data (e.g., SP_3rd) that are continuous, and thus the input data IDTA may include the first sub-pixel data SP_1st through the M*Nth sub-pixel data SP_3rd that are continuous. The data encoding unit 122_3 may generate the encoded data EDTA by encoding the first sub-pixel data SP_1st of the input data IDTA and differences between adjacent pieces of sub-pixel data from among the first sub-pixel data SP_1st through the M*Nth sub-pixel data SP_3rd of the input data IDTA. In FIG. 12, each pixel data may include, for example, three pieces of sub-pixel data R (Red), G (Green), and B (Blue).

For example, the encoded data EDTA may be encoded as the first sub-pixel data SP_1st of the input data IDTA, a difference Δ1 between the first sub-pixel data SP_1st and the second sub-pixel data SP_2nd of the input data IDTA, and a difference Δ2 between the second sub-pixel data SP_2nd and the third sub-pixel data SP_3rd of the input data IDTA through a difference between the M*N-1th sub-pixel data and the M*Nth sub-pixel data of the input data IDTA. In other words, first sub-pixel data SP11 of the encoded data EDTA may be the first sub-pixel data SP_1st of the input data IDTA, second sub-pixel data of the encoded data EDTA may be the difference Δ1 between the first sub-pixel data SP_1st and the second sub-pixel data SP_2nd of the input data IDTA, and third sub-pixel data of the encoded data EDTA may be the difference Δ2 between the second sub-pixel data SP_2nd and the third sub-pixel data SP_3rd of the input data IDTA. In the same manner, M*Nth sub-pixel data of the encoded data EDTA may be a difference between the M*N-1th sub-pixel data and the M*Nth sub-pixel data of the input data IDTA.

In this case, the second transition calculating unit 122_4 may count the number of 1s in the first sub-pixel data of the encoded data EDTA, may count the number of 1s in a result obtained by performing, for example, an XOR operation on the first sub-pixel data and the second sub-pixel data of the encoded data EDTA, and may count the number of 1s in a result obtained by performing, for example, an XOR operation on the second sub-pixel data and the third sub-pixel data of the encoded data EDTA. The second transition calculating unit 122_4 may perform, for example, an XOR operation on a difference between adjacent pieces of sub-pixel data of the encoded data EDTA and count the number of 1s in a result of the XOR operation until the XOR operation is performed on the M*N-1th sub-pixel data and the M*Nth sub-pixel data of the encoded data EDTA in the same manner. The second transition calculating unit 122_4 may sum the counted numbers of 1s and may count a transition count of the encoded data EDTA as the second value VAL2.

The aforementioned methods are merely examples, and the encoded data EDTA may be generated by using different methods. Referring back to FIG. 8, the comparison unit 122_5 may compare the first value VAL1 with the second value VAL2 and may output a comparison result CRST. The comparison result CRST may be referred to as first mode information XMD1. The data output unit 122_6 outputs one of the input data IDTA and the encoded data EDTA as the selection data SDTA according to the comparison result CRST. For example, when the first value VAL1 is less than the second value VAL2, the data output unit 122_6 may select the input data IDTA as the selection data SDTA. In contrast, when the second value VAL2 is less than the first value VAL1, the data output unit 122_6 may select the encoded data EDTA as the selection data SDTA.

The selection data SDTA may include the first mode information XMD1. Because the first mode information XMD1 indicates a result obtained by comparing the first value VAL1 with the second value VAL2, the first mode information XMD1 may include information about whether the selection data SDTA is the input data IDTA or the encoded data EDTA. As such, transition of data to be transmitted through the transmission channel CH may be reduced, thereby reducing power consumed by the timing controller 120.

Figure 13:
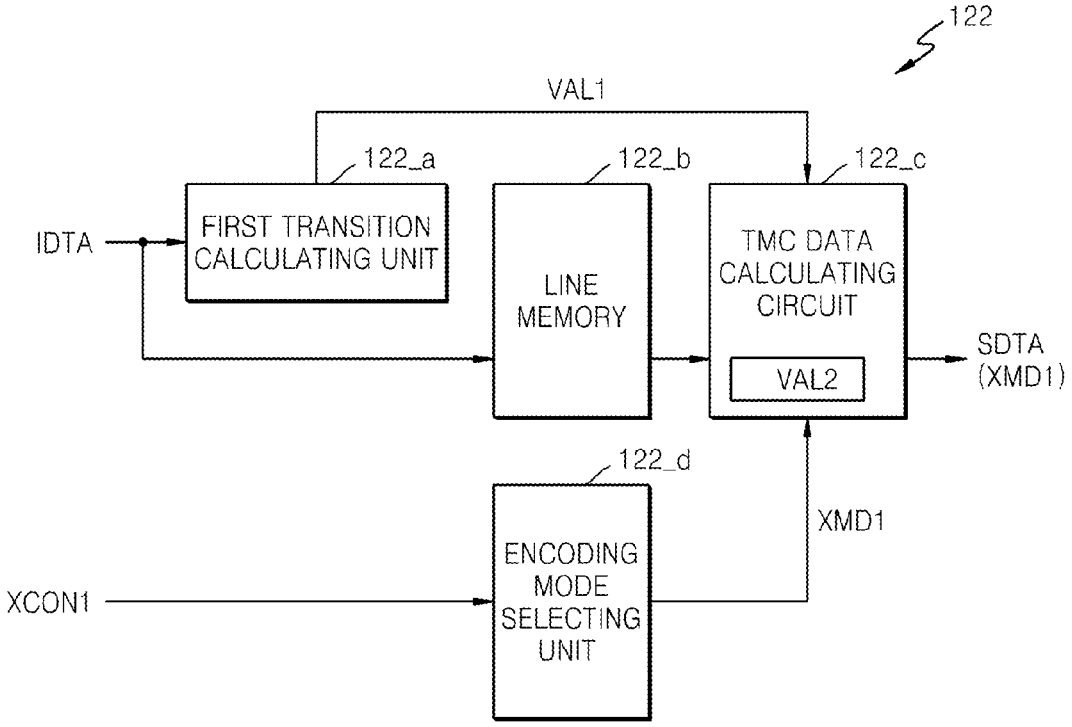
FIG. 13 is a block diagram of the data selecting unit according to an example embodiment of the inventive concepts.

FIG. 13 is a block diagram of the data selecting unit 122 according to an example embodiment of the inventive concepts. Referring to FIG. 13, the data selecting unit 122 may include a first transition calculating unit **122_*a*, a line memory 122_*b*, a transition minimized coding (TMC) data calculating circuit 122_*c*, and an encoding mode selecting unit 122_*d*. The first transition calculating unit 122_*a* may receive the input data IDTA and may calculate a transition count of the input data IDTA as the first value VAL1. An operation of the first transition calculating unit 122_*a* may be the same as that of the first transition calculating unit 122_2 of FIG. 8. The line memory 122_*b* may temporarily store the input data IDTA. The line memory 122_*b* may be the same as the data input unit 122_1 of FIG. 8. The input data IDTA that is stored in the line memory 122_*b* may be applied to the TMC data calculating circuit 122_*c***.

The TMC data calculating circuit **122_*c* may calculate the second value VAL2 by counting a transition count in a result obtained by encoding the input data IDTA. The TMC data calculating circuit 122_*c* may compare the first value VAL1 with the second value VAL2 and may select one of the input data IDTA and a result obtained by encoding the input data IDTA as the selection data SDTA. The TMC data calculating circuit 122_*c* may perform functions of the data encoding unit 122_3, the second transition calculating unit 122_4, and the comparison unit 122_5 of the data selecting unit 122 of FIG. 8**.

In response to a first control signal XCON1, the encoding mode selecting unit **122_*d* may select a method by using which the TMC data calculating circuit 122*c* encodes the input data IDTA. The first control signal XCON1 may be a signal set by a user, or a signal applied from a host that controls the display driving integrated circuit 100. For example, when a difference between adjacent pieces of pixel data is expected to be large, the first control signal XCON1 may be set to perform, for example, an encoding method of FIG. 11. In contrast, when a difference between adjacent pieces of pixel data is expected to be small, the first control signal XCON1 may be set to perform, for example, an encoding method of FIG. 12**.

The encoding mode selecting unit **122_*d* may transmit the first mode information XMD1, including information about an encoding method, to the TMC data calculating circuit 122_*c*. For example, the TMC data calculating circuit 122_*c* may receive the first mode information XMD1 and may control the input data IDTA to be encoded by using one of the encoding methods of FIGS. 11 and 12**.

The first mode information XMD1 may be included in the selection data SDTA as explained above with regard to the first mode information XMD1 of FIG. 8. Further, according to the present example embodiment the first mode information XMD1 includes not only information about whether the selection data SDTA is the input data IDTA or data obtained by encoding the input data IDTA but also information about an encoding method. For example, it is assumed that the first mode information XMD1 may be generated to have 2 bits. When the first mode information XMD1 is 0, it may indicate that the selection data SDTA is the input data IDTA. When the first mode information XMD1 is 01, it may indicate that the selection data SDTA is encoded data and an encoding method is that of FIG. 11. Also, when the first mode information XMD1 is 10, it may indicate that the selection data SDTA is encoded data and an encoding method is that of FIG. 12.

Heretofore, examples of encoding methods performed on the input data IDTA have been described. However, example embodiments are not limited thereto. When the source driving unit 140 includes the first through xth source drivers SD1, SD2, . . . , and SDx as shown in FIG. 4, the data selecting unit 122 may encode, by using different encoding methods with respect to a first portion of the input data IDTA corresponding to the first through xth pieces of output data ODTA1, ODTA2, . . . , and ODTAx applied to at least one of the first through xth source drivers SD1, SD2, . . . , and SDx and with respect to a second portion of the input data IDTA corresponding to the first through xth pieces of output data ODTA1, ODTA2, . . . , and ODTAx applied to other resource drivers. For example, the data selecting unit 122 may perform a different encoding method on each portion of the input data IDTA corresponding to the first through xth pieces of output data ODTA1, ODTA2, . . . , and ODTAx applied to the first through xth source drivers SD1, SD2, . . . , and SDx.

Referring back to FIG. 1, the timing controller 120 may reduce power consumption by selecting data having a less transition count as described above. Further, the timing controller 120 may reduce EMI due to repetition of the same data pattern on the transmission channel CH by randomizing the selection data SDTA that is selected by the data selecting unit 122, which will be explained herein below.

Figure 14:
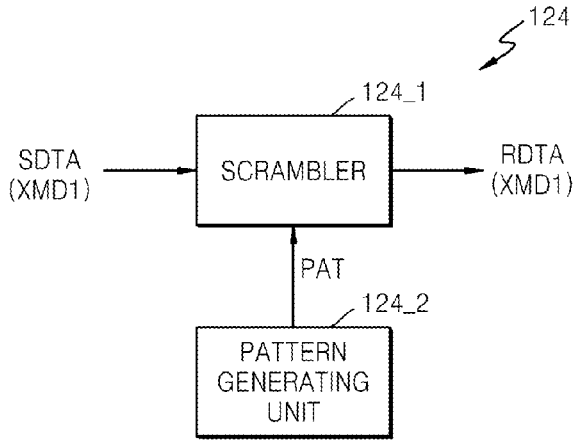
FIG. 14 is a block diagram of a data randomizing unit of FIG. 1, according to an example embodiment of the inventive concepts.

FIG. 14 is a block diagram of the data randomizing unit 124 of FIG. 1, according to an example embodiment of the inventive concepts. Referring to FIG. 14, the data randomizing unit 124 may include a scrambler 124_1 and a pattern generating unit 124_2. The scrambler 124_1 may perform, for example, an XOR operation on the selection data SDTA and may output random data RDTA. The selection data SDTA that is provided to the scrambler 124_1 may include the first mode information XMD1, and thus the random data RDTA may include the same first mode information XMD1 as the first mode information XMD1 included in the selection data SDTA.

The pattern generating unit 124_2 may generate a random pattern PAT and may transmit the random pattern PAT to the scrambler 124_1. However, the pattern generating unit 124_2 may be disposed outside the timing controller 120 or the display driving integrated circuit 100, and thus the random pattern PAT may be transmitted from the outside of the timing controller 120. When the source driving unit 140 includes the first through xth source drivers SD1, SD2, . . . , and SDx as shown in FIG. 4, the random pattern PAT may be generated as one logic value for every 1/x of a size of a horizontal line of a frame. For example, when 1/x of the size of the horizontal line of the frame is 12 bits, the pattern generating unit 124_2 may generate the random pattern PAT having the same logic value for every 12 bits of the selection data SDTA.

Figure 15A:
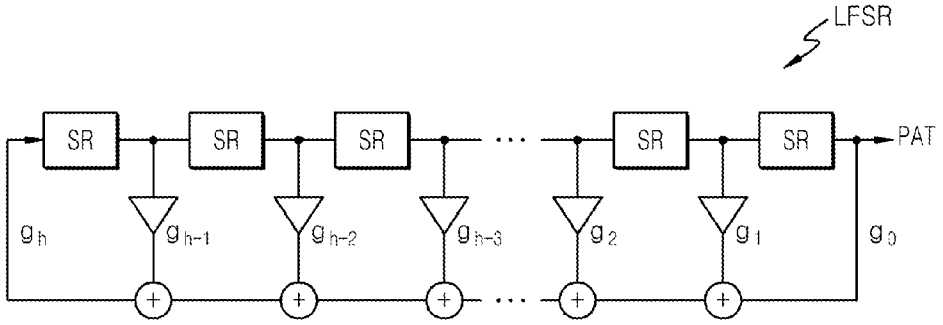
FIGS. 15A and 15B are diagrams illustrating a pattern generating unit of FIG. 14, according to some example embodiments of the inventive concepts.
Figure 15B:
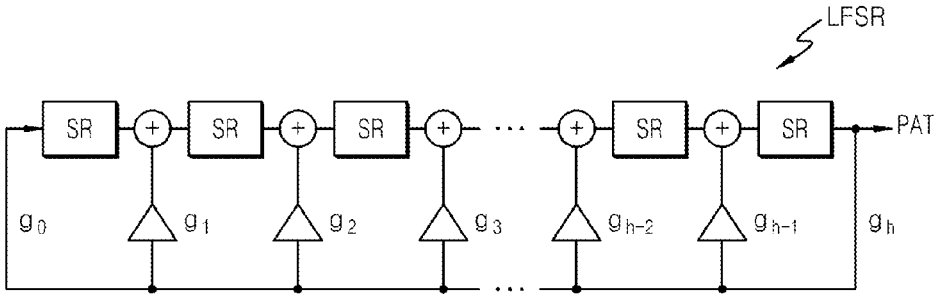

FIGS. 15A and 15B are diagrams illustrating the pattern generating unit 124_2 of FIG. 14, according to some example embodiments of the inventive concepts. Referring to FIG. 14 and FIGS. 15A and 15B, the pattern generating unit 124_2 may be, for example, a linear feedback shift register (LFSR). For example, the pattern generating unit 124_2 may include an LFSR that is a binary randomizer including h (where h is an integer equal to or greater than 2) shift registers SR. As described above, when 1/x of the size of the horizontal line of the frame is 12 bits, the LFSR of FIGS. 15A and 15B may include 24 shift registers SR. FIG. 15A illustrates a Fibonacci LFSR, and FIG. 15B illustrates a Galois LFSR. However, the LFSR according to example embodiments of the inventive concepts are not limited thereto. The random pattern PAT generated in FIG. 15 may be referred to as a pseudo random bit sequence (PRBS).

Figure 16:
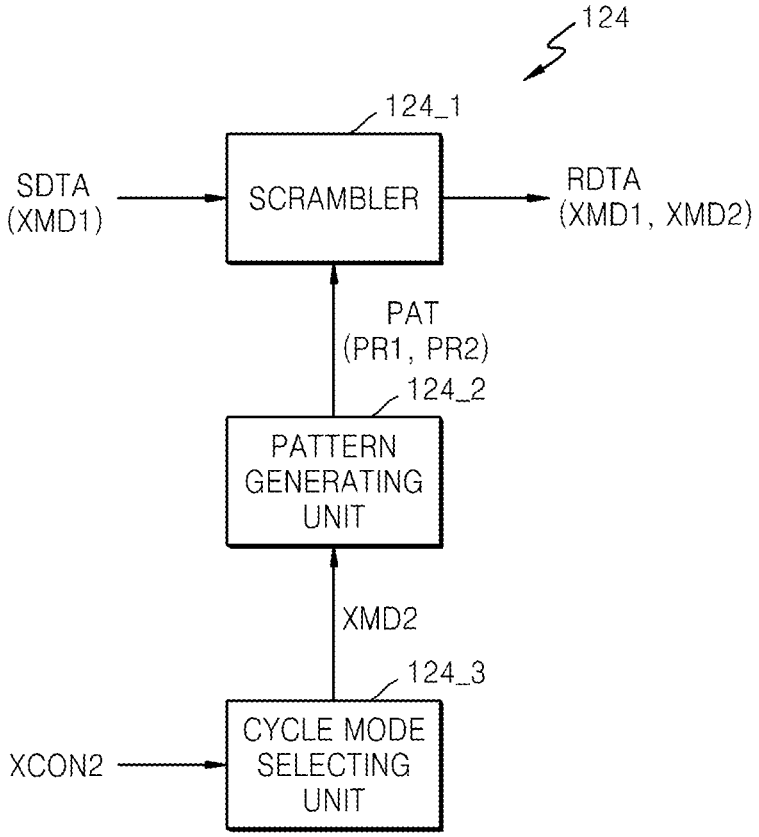
FIG. 16 is a block diagram of the data randomizing unit of FIG. 1, according to another example embodiment of the inventive concepts.

FIG. 16 is a block diagram of the data randomizing unit 124 of FIG. 1, according to another example embodiment of the inventive concepts. Referring to FIG. 16, the data randomizing unit 124 may include the scrambler 124_1 and the pattern generating unit 124_2, similar to FIG. 14. Furthermore, the data randomizing unit 124 of FIG. 16 may include a cycle mode selecting unit 124_3. In response to a second control signal XCON2, the cycle mode selecting unit 124_3 may output second mode information XMD2 indicating a cycle of the random pattern PAT that is generated by using the LFSR as shown in FIG. 15. For example, the cycle mode selecting unit 124_3 may generate the second mode information XMD2 such that a first cycle PR1 corresponding to a size of a horizontal line of a frame is set to the random pattern PAT. In this case, the pattern generating unit 124_2 may receive the second mode information XMD2 and may generate the random pattern PAT at each input data IDTA having the same size as that of the horizontal line of the frame. For example, the cycle mode selecting unit 124_3 may generate the second mode information XMD2 such that a second cycle PR2 corresponding to a size of a frame is set to the random pattern PAT. In this case, the pattern generating unit 124_2 may receive the second mode information XMD2 and may generate the random pattern PAT at each frame. The scrambler 124_1 of FIG. 16 may perform, for example, an XOR operation on the selection data SDTA and the random pattern PAT that is generated in the first cycle PR1 or the second cycle PR2 and output the random data RDTA. In this case, the random data RDTA may include the second mode information XMD2.

The second control signal XCON2 may be a signal set by the user or a signal applied from the host that controls the display driving integrated circuit 100, like the first control signal XCON1. For example, when the selection data SDTA of a similar pattern are generated or are expected to be generated a desired (or alternatively, predetermined) number of times or more, the first cycle PR1 may be selected in order to increase the degree of randomization. In contrast, when the selection data SDTA are generated in different patterns, the second cycle PR2 may be selected to reduce the degree of randomization. For example, when EMI is a more serious issue than power consumption in the display driving integrated circuit 100, the second control signal XCON2 may be set to select the first cycle PR1 in order to increase the degree of randomization. In contrast, when power consumption is a more serious issue than EMI in the display driving integrated circuit 100, the second control signal XCON2 may be set to select the second cycle PR2 in order to reduce the degree of randomization.

For example, it is assumed that the second mode information XMD2 is generated to have one bit. When the second mode information XMD2 is 0, the first cycle PR1 may be selected, and when the second mode information XMD2 is 1, the second cycle PR2 may be selected. The selection data SDTA that is applied to the scrambler 124_1 may include the first mode information XMD1, and thus the random data RDTA may include the same first mode information XMD1 as the first mode information XMD1 included in the selection data SDTA. Furthermore, the random data RDTA may further include the second mode information XMD2.

Figure 17A:
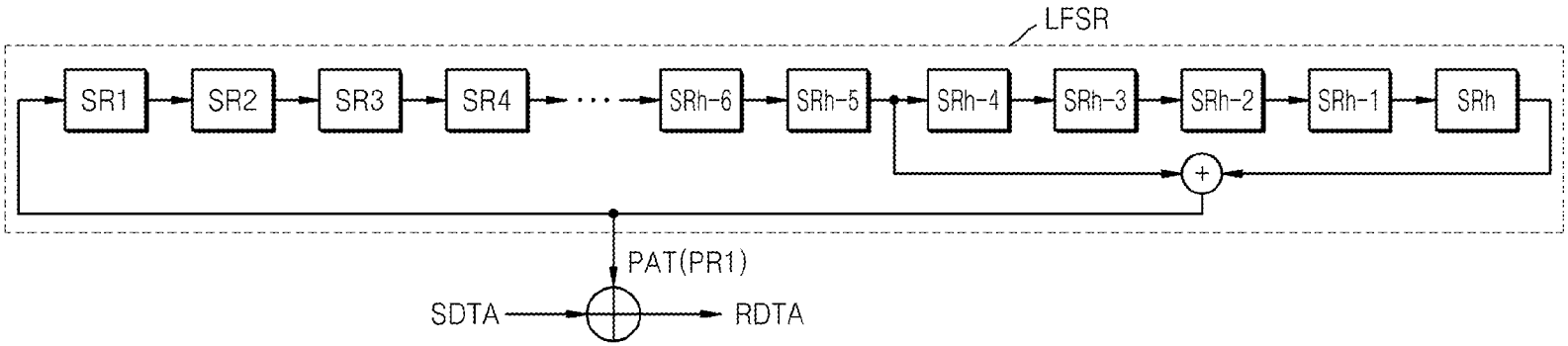
FIGS. 17A and 17B are diagrams illustrating a pattern generating unit of FIG. 16, according to some example embodiments of the inventive concepts.
Figure 17B:
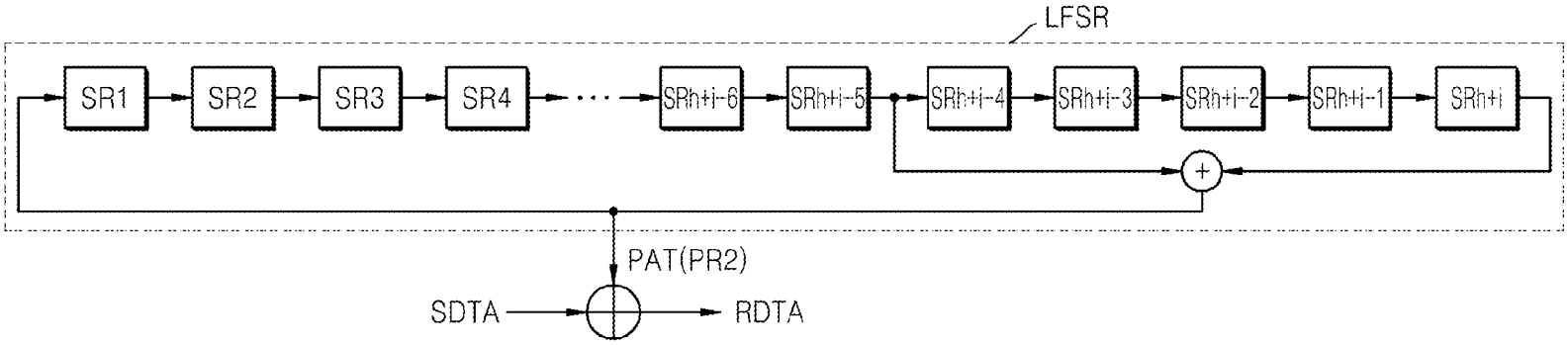

FIGS. 17A and 17B are diagrams illustrating the pattern generating unit 124_2 of FIG. 16, according to some example embodiments of the inventive concepts. In FIG. 17A, an LFSR may include h shift registers (e.g., first through hth shift registers SR1 through SRh). An output (e.g., the random pattern PAT) of the LFSR of FIG. 17A may be a result obtained by performing, for example, an XOR operation on an output of the hth shift register h that is a last shift register from among the first through hth shift registers SR1 through SRh, which are serially connected, and an output of an arbitrary one of the shift registers (e.g., a h-5th shift register SRh-5) from among the first through hth shift registers SR1 through SRh. The random pattern PAT may be fed back and be input to the first shift register SR1 from among the first through hth shift registers SR1 through SRh. The h-5th shift register SRh-5 that outputs an output on which, for example, an XOR operation may be performed along with an output of the hth shift register SRh may be set to correspond to a desired degree of randomization. In this case, a cycle of the random pattern PAT of FIG. 17A may be $2^h-1$ when the LFSR of FIG. 17A is defined by a primitive polynomial having weight values $g_h$, $g_{h-1}$, . . . , and $g_0$ of FIG. 15 as coefficients.

An LFSR of FIG. 17B may include h+i shift registers (e.g., first through h+ith shift registers SR1 through SRh+i), which is greater in number than that the LFSR illustrated in FIG. 17A. An operation of the LFSR of FIG. 17B may be the same as or similar to that of the LFSR of FIG. 17A. However, a cycle of the random pattern PAT of FIG. 17B may be $2^{h+i}-1$ that is greater than that of the random pattern PAT of FIG. 17A.

The random pattern PAT may be controlled to be generated in the first cycle PR1 or in the second cycle PR2 by adjusting the number of shift registers in FIG. 17A or the number of shift registers in FIG. 17B. In this case, the pattern generating unit 124_2 may not include a separate LFSR in each cycle, and may vary a cycle by switching connection between some shift registers of one LFSR.

Figure 18:
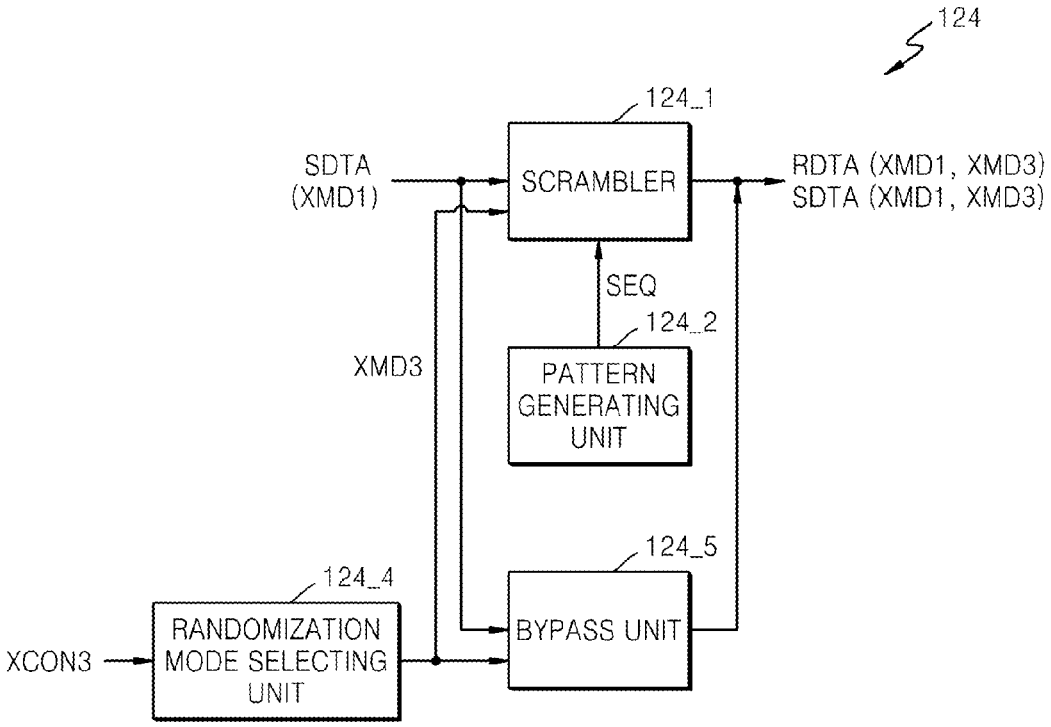
FIG. 18 is a block diagram of the data randomizing unit of FIG. 1, according to still another example embodiment of the inventive concepts.

FIG. 18 is a block diagram of the data randomizing unit 124 of FIG. 1, according to still another example embodiment of the inventive concepts. Referring to FIG. 18, the data randomizing unit 124 includes the scrambler 124_1 and the pattern generating unit 124_2, like in FIG. 14. Furthermore, the data randomizing unit 124 of FIG. 18 may include a randomization mode selecting unit 124_4 and a bypass unit 124_5. In response to a third control signal XCON3, the randomization mode selecting unit 124_4 may output third mode information XMD3 indicating whether the selection data SDTA is randomized. The third control signal XCON3 may be a signal set by the user or a signal applied from the host that controls the display driving integrated circuit 100, like the first control signal XCON1 or the second control signal XCON2. For example, the third control signal XCON3 may be set to perform randomization in order to reduce both power consumption and EMI in the display driving integrated circuit 100. In contrast, when EMI is a more serious issue than power consumption in the display driving integrated circuit 100, the third control signal XCON3 may be set to omit randomization to reduce transition of data due to the randomization.

For example, it is assumed that the third mode information XMD3 is generated to have one bit. When the third mode information XMD3 is 0, it may indicate that randomization is not performed and bypass the selection data SDTA (meaning directly passing the selection data SDTA to the data transmitting unit in response to the third mode information). When the third mode information XMD3 is 1, it may indicate that the selection data SDTA is randomized. The bypass unit 124_5 may bypass the selection data SDTA to the data transmitting unit 126 in response to the third mode information XMD3 that is 0. In contrast, when the third mode information XMD3 that is 1 is received, the bypass unit 124_5 may be deactivated or may not operate. For example, when the third mode information XMD3 that is 0 is received, the scrambler 124_1 does not perform, the randomization as shown in FIG. 14, and in contrast, when the third mode information XMD3 that is 1 is received, the scrambler 124_1 performs, the randomization as shown in FIG. 14.

The selection data SDTA that is applied to the scrambler 124_1 may include the first mode information XMD1, and thus the random data RDTA may include a first mode information XMD1 that is the same information as the first mode information XMD1 included in the selection data SDTA. Furthermore, the random data RDTA may further include the third mode information XMD3. The pattern generating unit 124_2 of FIG. 18 may be the same as the pattern generating unit 124_2 of FIG. 14, and thus a detailed explanation thereof will not be given. The selection data SDTA on which randomization is not performed and is bypassed in FIG. 18 may be transmitted to the data transmitting unit 126 of FIG. 1, and the data transmitting unit 126 may convert the bypassed selection data SDTA into the output data ODTA and may output the output data ODTA.

A cycle of a random pattern or whether to perform randomization may be determined by performing different encoding methods with respect to respective portions of the random data RDTA corresponding to the first through xth pieces of output data ODTA1, ODTA2, . . . , and ODTAx that are applied to the first through xth source drivers SD1, SD2, . . . , and SDx.

Figure 19:
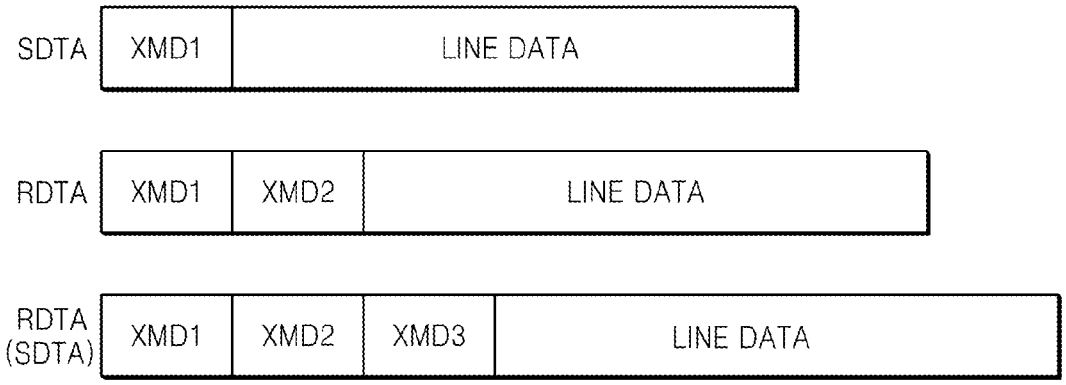
FIG. 19 is a conceptual diagram illustrating structures of various data, according to an example embodiment of the inventive concepts.

FIG. 19 is a conceptual diagram illustrating structures of various data, according to an example embodiment of the inventive concepts. Referring to FIGS. 1 and 19, data having a less transition count from among the input data IDTA and the encoded data EDTA may be selected as the selection data SDTA. The selection data SDTA may include the first mode information XMD1, which indicates which data is selected, as a header. Further, as described above, the input data IDTA is data corresponding to a horizontal line. The encoded data EDTA may be generated to have the same size as that of the input data IDTA because encoding is performed to show whether each bit of the input data IDTA is changed, as described with reference to FIG. 11 or 12. The first mode information XMD1 may include information about an encoding method as well as information about data having a less transition count from among the input data IDTA and the encoded data EDTA.

The random data RDTA may include the same first mode information XMD1 as that of the selection data SDTA, and may further include the second mode information XMD2 about a cycle of the random pattern PAT as described with reference to FIG. 16. When the randomization is selectively performed as described with reference to FIG. 18, the random data RDTA may further include the third mode information XMD3 about whether randomization is performed or not. In this case, when the third mode information XMD3 indicates that randomization is not performed, a header of the bypassed selection data SDTA may also include the first mode information XMD1, the second mode information XMD2, and the third mode information XMD3.

Figure 20:
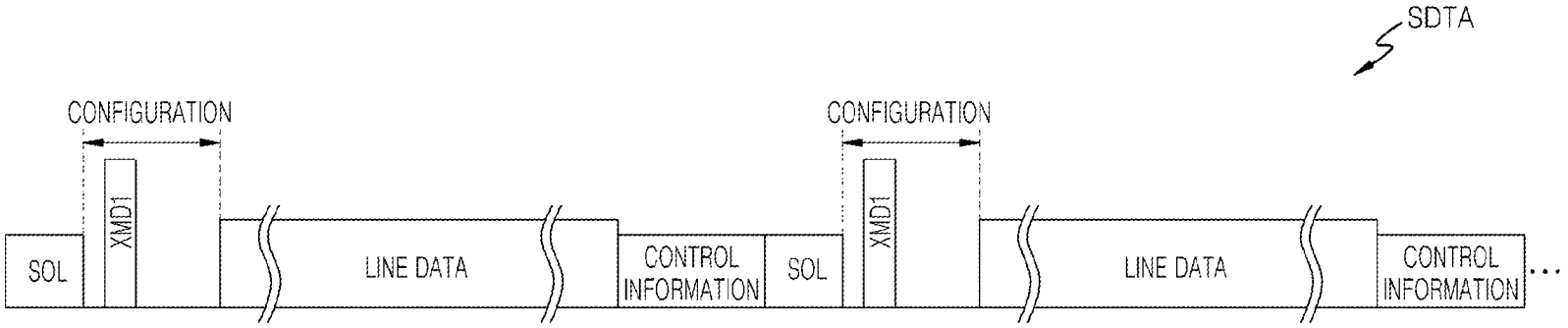
FIGS. 20 through 22 are detailed diagrams illustrating packets of various data of FIG. 19, according to some example embodiments of the inventive concepts.
Figure 21:
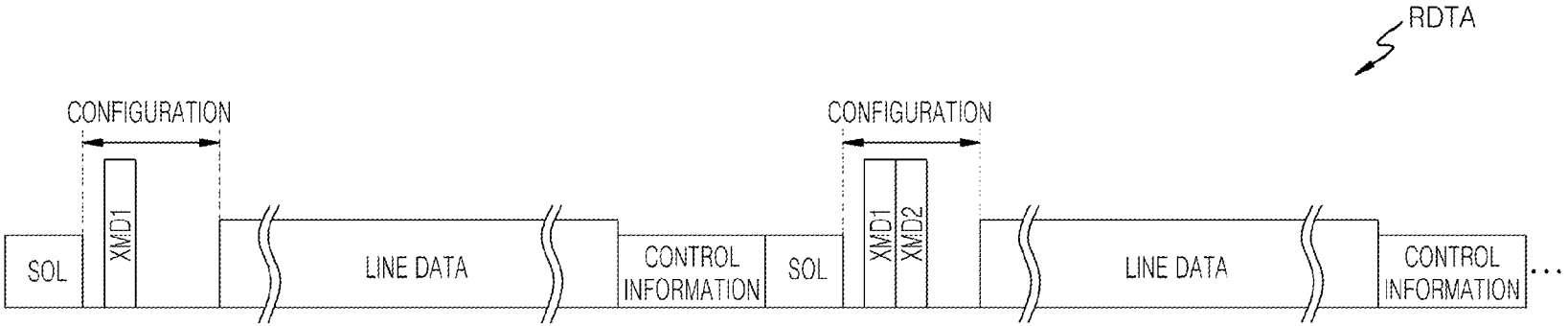
Figure 22:
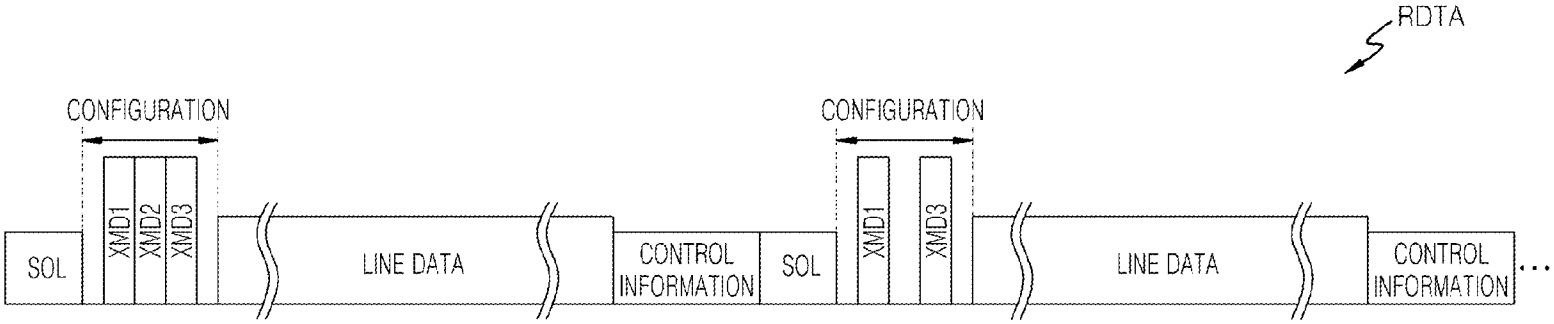

FIGS. 20 through 22 are detailed diagrams illustrating packets of various data of FIG. 19, according to some example embodiments of the inventive concepts. In the packets of FIGS. 20 through 22, for example, data (e.g., a start of line (SOL)) other than line data may indicate that packetization is performed at an output stage. First, referring to FIG. 20, the selection data SDTA may be packetized to include a header including an SOL indicating that the selection data SDTA is data corresponding to a new line and the first mode information XMD1, a payload including effective data (line data or pixel data), and a tail including control information.

Next, referring to FIG. 21, the random data RDTA may be packetized to include a header including an SOL indicating that the random data RDTA is data corresponding to a new line and the first mode information XMD1, a payload including effective data (line data or pixel data), and a tail including control information, as in the selection data SDTA. The header of the random data RDTA may further include the first mode information XMD2. In this case, whether to include the second mode information XMD2 may be different in each line as shown in FIG. 21. For example, the cycle mode selecting unit 124_3 of FIG. 16 may selectively operate in each line. For example, the random data RDTA may include the first mode information XMD1 through the third mode information XMD3 in the header, as illustrated in FIG. 22. For example, each line may include all of the second mode information XMD2 and the third mode information XMD3, may not include any of the second mode information XMD2 and the third mode information XMD3, or may include one of the second mode information XMD2 and the third mode information XMD3.

Figure 23:
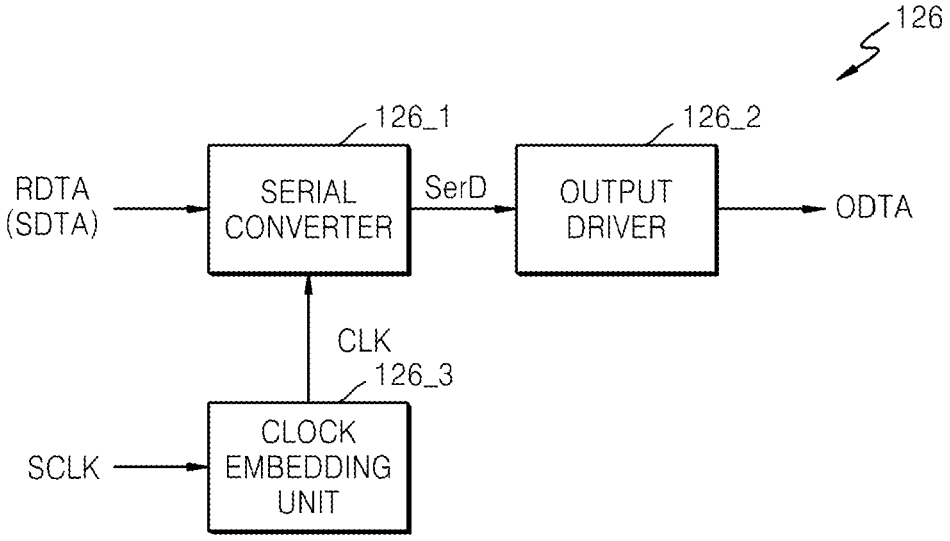
FIG. 23 is a block diagram of a data transmitting unit of FIG. 1, according to an example embodiment of the inventive concepts.

FIG. 23 is a block diagram of the data transmitting unit 126 of FIG. 1, according to an example embodiment of the inventive concepts. Referring to FIG. 23, the data transmitting unit 126 may further include a serial converter 126_1, an output driver 126_2, and a clock embedding unit 126_3. The serial converter 126_1 may serialize the random data RDTA into serial data SerD. However, when the bypassed selection data SDTA of FIG. 18, instead of the random data RDTA, is input to the serial converter 126_1, the serial converter 126_1 may serialize the bypassed selection data SDTA. The output driver 126_2 may transmit the serial data SerD as the output data ODTA to the transmission channel CH. As described above, when the source driving unit 140 includes the first through xth source drivers SD1, SD2, . . . , and SDx, x output drivers 126_2 that are connected through different transmission channels to the first through xth source drivers SD1, SD2, . . . , and SDx may be provided.

The clock embedding unit 126_3 may embed the clock signal CLK into the serial data SerD. The clock embedding unit 126_3 may generate a logic value by inverting a logic value of a bit right before the clock signal CLK is embedded, which will be explained below in detail. When the source driving unit 140 includes the first through xth source drivers SD1, SD2, . . . , and SDx, the source driving unit 140 may embed a clock signal at every x units T of FIG. 5. The clock embedding unit 126_3 may be synchronized with a system clock signal CLK and may perform clock embedding. The system clock signal CLK may be an operation clock signal of the display driving integrated circuit 100 or a clock signal applied from the outside of the display driving integrated circuit 100.

Figure 24:
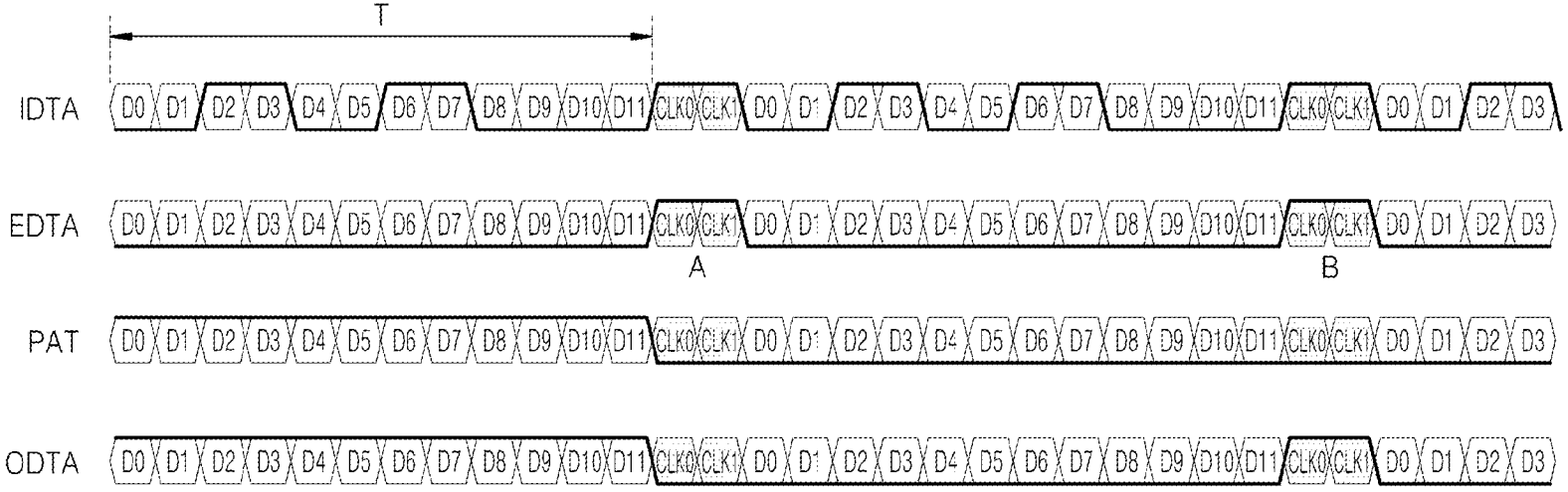
FIG. 24 is a diagram for explaining an operation of the display driving integrated circuit, according to an example embodiment of the inventive concepts.

FIG. 24 is a diagram for explaining an operation of the display driving integrated circuit 100, according to an example embodiment of the inventive concepts. Referring to FIGS. 4 and 24, a payload of the input data IDTA may be divided in T units that (e.g., each 12 bits D0 through D11). Although the clock signal CLK is embedded into the input data IDTA in FIG. 24 for the purpose of explaining an operation of the display driving integrated circuit 100, and the clock signal CLK may be embedded while serialization is performed in the data transmitting unit 126 as described above. Also, although the input data IDTA is serialized in FIG. 24 for the purpose of explaining an operation of the display driving integrated circuit 100, and serialization may be performed after the input data IDTA or the random data RDTA is transmitted to the data transmitting unit 126. The same applies to the encoded data EDTA and the random pattern PAT of FIG. 24.

In FIG. 24, the clock signal CLK may be embedded with two bits. Also, a logic value (0 or 1) of the clock signal CLK of FIG. 24 is a value obtained by inverting a logic value of a bit (e.g., a last bit included in a T unit) right before the clock signal CLK. For example, upon examining first clock signals CLK0 and CLK1 of the input data IDTA, when a logic value of a bit D11 (e.g., a last bit included in one of the T units) right before the first clock signals CLK0 and CLK1 is 0, each of the first clock signals CLK0 and CLK1 may be embedded with a logic value of 1. In contrast, when a logic value of a bit D11 right before the first clock signals CLK0 and CLK1 of the random pattern PAT is 1, each of the first clock signals CLK0 and CLK1 may be embedded with a logic value of 0.

Upon examining 12 bits D0 through D11 of a first one of the T units of the input data IDTA, bits D2, D3, D6, and D7 have logic values of 1, and the other bits have logic values of 0. In contrast, all of 12 bits D0 through D11 of a first T unit of the encoded data EDTA have logic values of 0. Thus, a transition count of the encoded data EDTA is less than that of the input data IDTA. Accordingly, the encoded data EDTA is selected as the selection data SDTA. For example, an XOR operation may be performed on the selection data SDTA and the random pattern PAT to obtain the random data RDTA.

The random pattern PAT may be generated as one logic value in each of the T units. In FIG. 24, the random pattern PAT may have a logic value of 1 in a first one of the T units, and may have a logic value of 0 in a second one of the T units and a third one of the T units. The output data ODTA or the random data RDTA may be a result obtained by performing, for example, an XOR operation on the selected encoded data EDTA and the random pattern PAT. FIG. 24 illustrates a result obtained by performing an XOR operation on the encoded data EDTA and the random pattern PAT for convenience of explanation. The result will be transmitted as the output data ODTA.

In the first one of the T units, because all of 12 bits D0 through D11 of the encoded data EDTA have logic values of 0 and all of 12 bits D0 through D11 of the random pattern PAT have logic values of 1, a result obtained by performing, for example, an XOR operation on corresponding bits (for example, the bit D0 of the encoded data EDTA and the bit D0 of the random pattern PAT) may be transmitted as the output data ODTA. Accordingly, in the first one of the T units, all of 12 bits D0 through D11 of the output data ODTA have logic values of 1. As described above, because the clock signal CLK is configured to have a value obtained by inverting a logic value of the bit D11 right before the clock signal CLK, the first clock signals CLK0 and CLK1 of the output data ODTA have logic values of 0. In contrast, the first clock signals CLK0 and CLK1 of the output data ODTA have logic values of 1 obtained by inverting a logic value of the bit D11 right before the first clock signals CLK0 and CLK1.

In FIG. 24, the timing controller 120 may reduce power consumed by, for example, the output driver 126_2, by outputting the output data ODTA corresponding to the encoded data EDTA having a less transition count than the input data IDTA. Although a transition count is reduced, when a pattern of the encoded data EDTA is repeated, the influence of EMI on the transmission channel CH through which the output data ODTA corresponding to the encoded data EDTA is transmitted may be increased. However, as shown in FIG. 24, repetition of a pattern of the output data ODTA corresponding to the encoded data EDTA may be reduced by randomizing the selected encoded data EDTA. In this case, transition of data due to randomization may be reduced by generating the random pattern PAT that is used to randomize the encoded data EDTA to have one logic value in each of the T units, which is handled by each source driver for one horizontal line, instead of in each bit.

Figure 25:
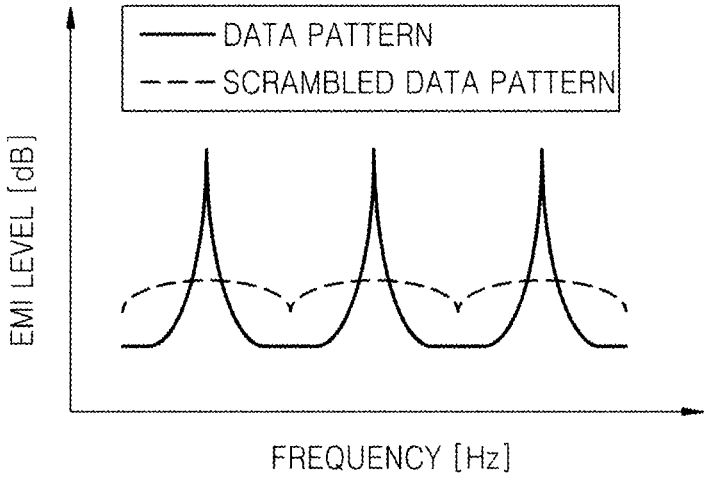
FIG. 25 is a graph illustrating the degree of electromagnetic interference (EMI) in output data of FIG. 24, according to an example embodiment of the inventive concepts.

FIG. 25 is a graph illustrating the degree of EMI in the output data ODTA of FIG. 24, according to an example embodiment of the inventive concepts. Referring to FIG. 25, an EMI level (solid line) of a general data pattern is considerably high in some parts whereas an EMI level (dashed line) of a randomized data pattern according to an example embodiment of the inventive concepts may be relatively uniform and may be maintained at a relatively lower level in all parts. As such, the display driving integrated circuit 100 may reduce EMI, thereby improving an accuracy of a data-based operation.

Figure 26:
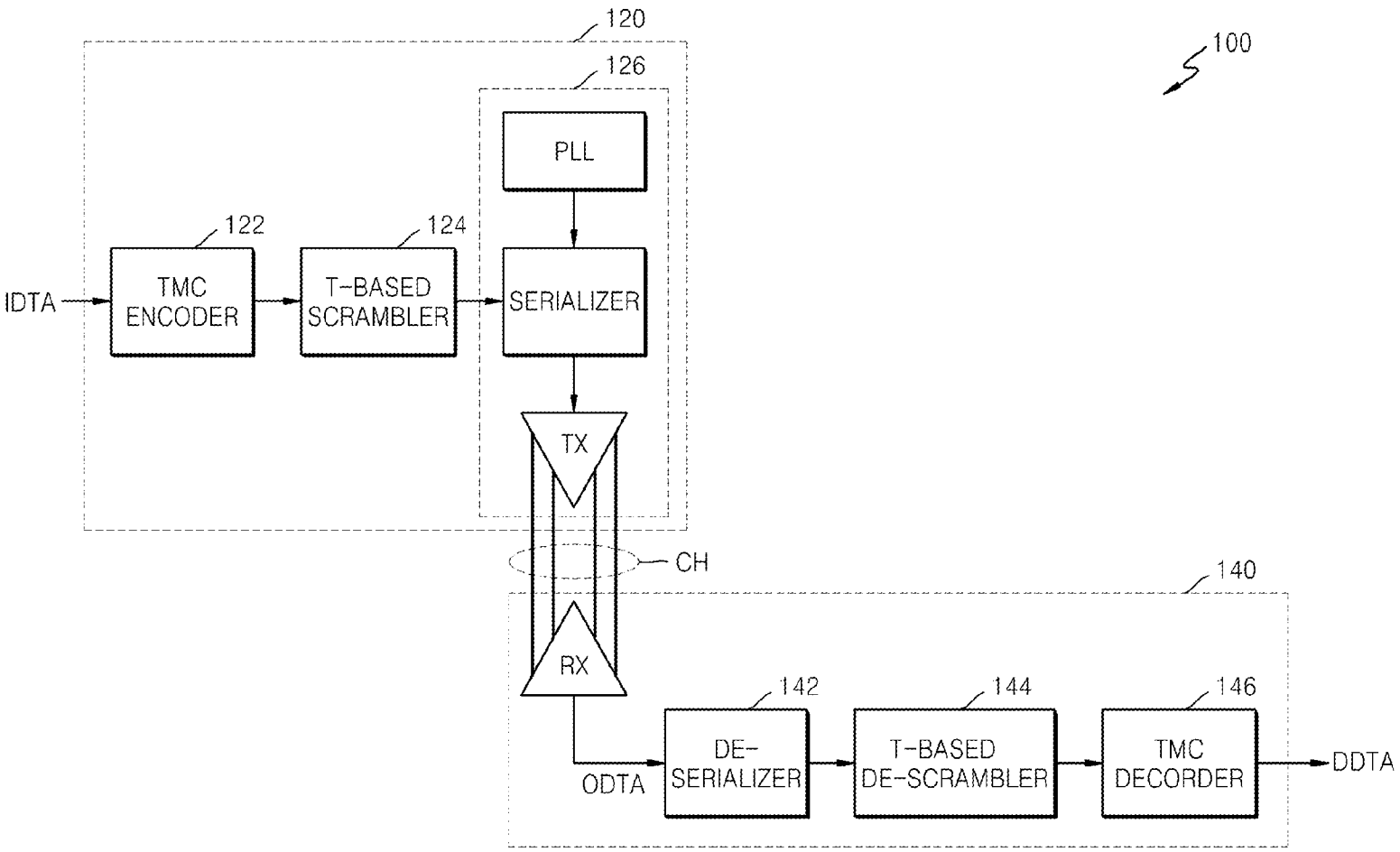
FIG. 26 is a detailed block diagram of the display driving integrated circuit according to an example embodiment of the inventive concepts.

FIG. 26 is a detailed block diagram of the display driving integrated circuit 100, according to an example embodiment of the inventive concepts. Referring to FIG. 26, the display driving integrated circuit 100 may include the timing controller 120 and the source driving unit 140. The timing controller 120 may include a TMC encoder 122, a T-based scrambler 124, and the data transmitting unit 126. The TMC encoder 122 and the T-based scrambler 124 may perform the same functions as those of the data selecting unit 122 and the data randomizing unit 124 of FIG. 1, and thus are denoted by the same reference numerals. The TMC encoder 122 and the T-based scrambler 124 of FIG. 26 are named to indicate functions of the data selecting unit 122 and the data randomizing unit 124, respectively. For example, in FIG. 26, the data selecting unit 122 may function to minimize transition of data, and the data randomizing unit 124 may function to perform randomization with respect to the T units of FIG. 5.

The data transmitting unit 126 of FIG. 26 may perform the same function as that of the data transmitting unit 126 of FIG. 1. For example, a phase locked loop (PLL) and the output driver 126_2 in the data transmitting unit 126 of FIG. 26 may correspond to the clock embedding unit 126_3 of FIG. 23. In FIG. 26, an output driver Tx and a reception driver Rx of the source driving unit 140 may be connected to each other via an eRVDS interface.

The source driving unit 140 may inversely convert the output data ODTA that is input through the reception driver Rx. For example, the source driving unit 140 may include a de-serializer 142, a de-scrambler 144, and a decoder 146. In this case, the decoder 146 may perform inverse conversion according to the first mode information XMD1 that is included in the output data ODTA. When the output data ODTA also includes the second mode information XMD2 or the third mode information XMD3, the de-scrambler 144 may perform inverse conversion according to the second mode information XMD2 or the third mode information XMD3. Although the source driving unit 140 including one source driver is illustrated in FIG. 26, the source driving unit 140 may include the first through xth source drivers SD1, SD2, . . . , and Sdx and each of the first through xth source drivers SD1, SD2, . . . , and SDx may perform inverse conversion as described with reference to FIG. 4.

Figure 27:
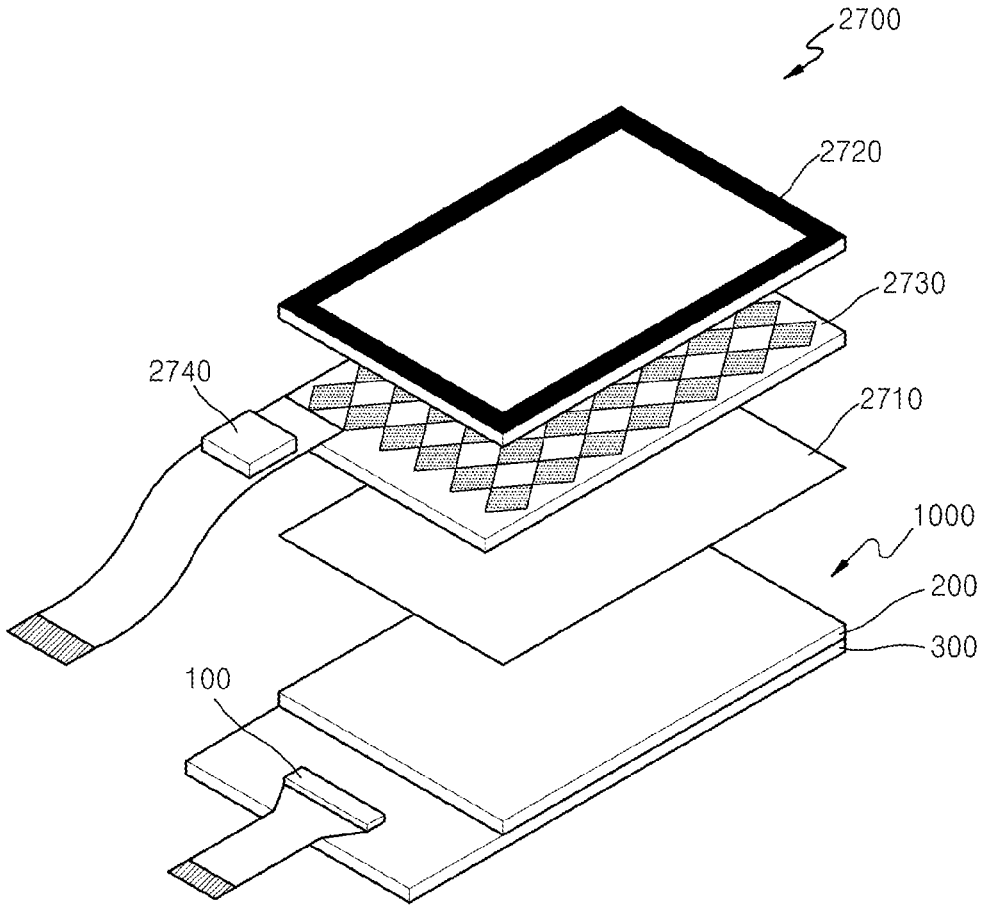
FIG. 27 is a exploded perspective view illustrating a display module according to an example embodiment of the inventive concepts.

FIG. 27 is an exploded perspective view illustrating a display module according to an example embodiment of the inventive concepts. Referring to FIG. 27, a display module 2700 may include a display device 1000, a polarizing plate 2710, and a window glass 2720. The display device 1000 may include a display panel 200, a printed board 300, and a display driving integrated circuit 100.

The window glass 2720 may be generally formed of, for example, acryl or tempered glass, and may protect the display module 2700 from being scratched due to a repeated touch or an external impact. The polarizing plate 2710 may be provided to improve optical characteristics of the display panel 200. The display panel 200 may be patterned and formed as a transparent electrode on the printed board 300. The display panel 200 may include a plurality of pixel cells for displaying a frame. The display panel 200 may be, for example, an organic light-emitting diode panel. Each of the pixel cells may include an organic light-emitting diode, which emits light in response to a flow of current. However, example embodiments are not limited thereto, and the display panel 200 may include different display elements. For example, the display panel 200 may be one of an LCD panel, an electrochromic display (ECD) panel, a digital mirror device (DMD), an actuated mirror device (AMD), a grating light valve (GLV), a plasma display panel (PDP), an electro luminescent display (ELD) panel, a light-emitting diode (LED) display panel, and a vacuum fluorescent display (VFD) panel.

The display driving integrated circuit 100 may include the display driving integrated circuit 100 of FIG. 1. Although the display driving integrated circuit 100 is one chip in FIG. 27 for convenience of explanation, example embodiments are not limited thereto, and the display driving integrated circuit 100 may be mounted as a plurality of chips. The display driving integrated circuit 100 may be mounted as a chip-on-glass (COG) type on the printed board 300. However, example embodiments are not limited thereto, and the display driving integrated circuit 100 may be mounted as any of various types such as a chip-on-film (COF) type or a chip-on-board (COB) type.

The display module 2700 may further include a touch panel 2730 and a touch controller 2740. The touch panel 2730 may be formed by patterning a transparent electrode such as an electrode formed of, for example, indium tin oxide (ITO) on a glass substrate or a polyethylene terephthalate (PET) film. The touch controller 2740 may detect a touch on the touch panel 2730, calculate coordinates of the touch, and transmit the coordinates to a host (not shown). The touch controller 2740 may be integrated with the display driving integrated circuit 100 into one semiconductor chip.

Figure 28:
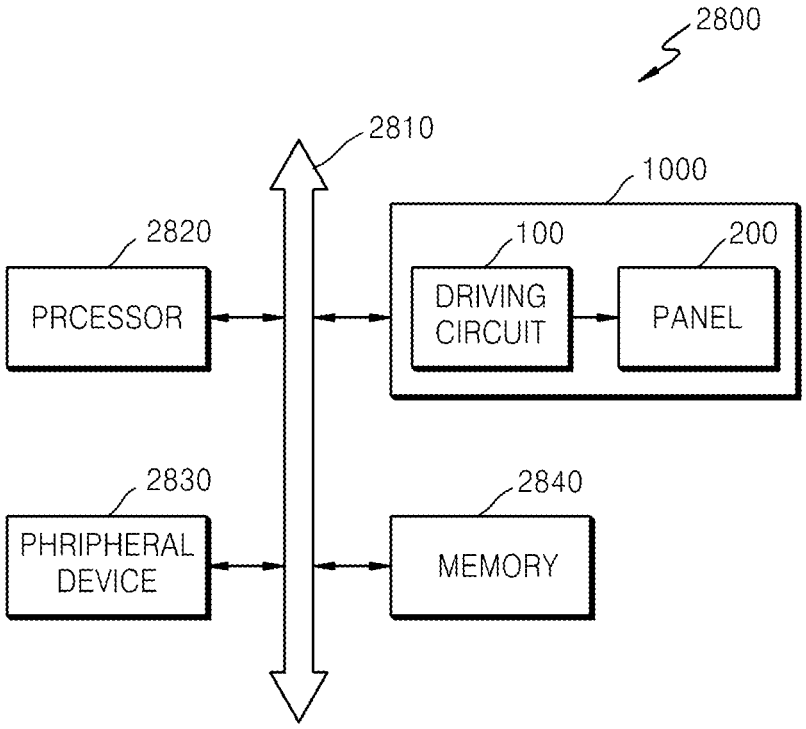
FIG. 28 is a block diagram of a display system according to an example embodiment of the inventive concepts.

FIG. 28 is a block diagram of a display system according to an example embodiment of the inventive concepts. Referring to FIG. 28, the display system 2800 may include a processor 2820, a display device 1000, a peripheral device 2830, and a memory 2840 that are electrically connected to a system bus 2810.

The processor 2820 may control data to be input/output to/from the peripheral device 2830, the memory 2840, and the display device 1000, and may perform image processing on image data transmitted among the peripheral device 2830, the memory 2840, and the display device 1000. The display device 1000 may include a display panel 200 and a display driving integrated circuit 100. The display device 1000 may store image data that is supplied from the system bus 2810 in a frame memory or a line memory included in the display driving integrated circuit 100, and display the image data on the display panel 200. The display device 1000 may be the display device 1000 of FIG. 2.

The peripheral device 2830 may be a device that converts a moving image or a still image into an electrical signal, for example, a camera, a scanner, or a webcam. Image data that is obtained by the peripheral device 2830 may be stored in the memory 2840, or may be displayed in real time on the display panel 200 of the display device 1000. The memory 2840 may include a volatile memory element, for example, dynamic random-access memory (DRAM) and/or a non-volatile memory element (e.g., a flash memory). Examples of the memory 2840 may include DRAM, phase change random-access memory (PRAM), magnetic random-access memory (MRAM), resistive random-access memory (Re-RAM), ferroelectric random-access memory (FRAM), a NOR flash memory, a NAND flash memory, and a fusion flash memory (e.g., a memory in which a static random-access memory (SRAM) buffer, a NAND flash memory, and a NOR interface logic are combined). The memory 2840 may store image data that is obtained from the peripheral device 2830 or may store an image signal that is processed by the processor 2820.

The display system 2800 may be provided in a mobile electronic device (e.g., a tablet PC). However, example embodiments are not limited thereto, and the display system 2800 may be provided in any of various electronic devices that may display an image.

Figure 29:
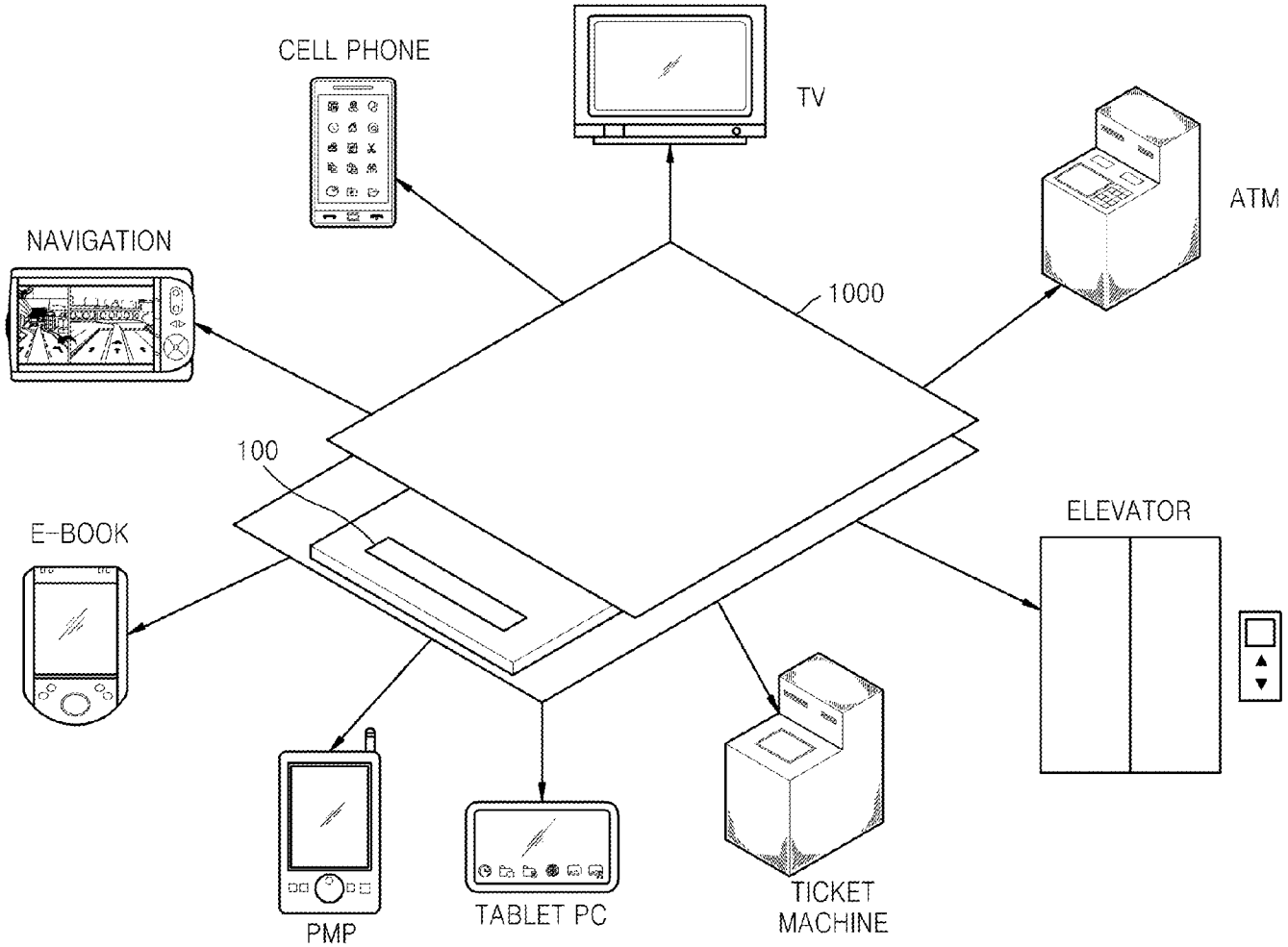
FIG. 29 is a view illustrating various electronic devices to which the display device is applied, according to an example embodiment of the inventive concepts.

FIG. 29 is a view illustrating various electronic devices to which the display device 1000 is applied, according to an example embodiment of the inventive concepts. The display device 1000 may be provided to any of various electronic devices. The display device 1000 may be widely applied to, for example, a mobile phone, an automated teller machine (ATM) that automatically performs cash deposit and withdrawal at banks, an elevator, a ticket issuer that is used in a subway station or the like, a portable multimedia player (PMP), an e-book, a navigation system, and a tablet PC. The display device 1000 may include a display driving integrated circuit 100 that may reduce power consumption and EMI. Accordingly, various electronic devices including the display device 1000 may accurately operate with low power consumption.

Figure 30:
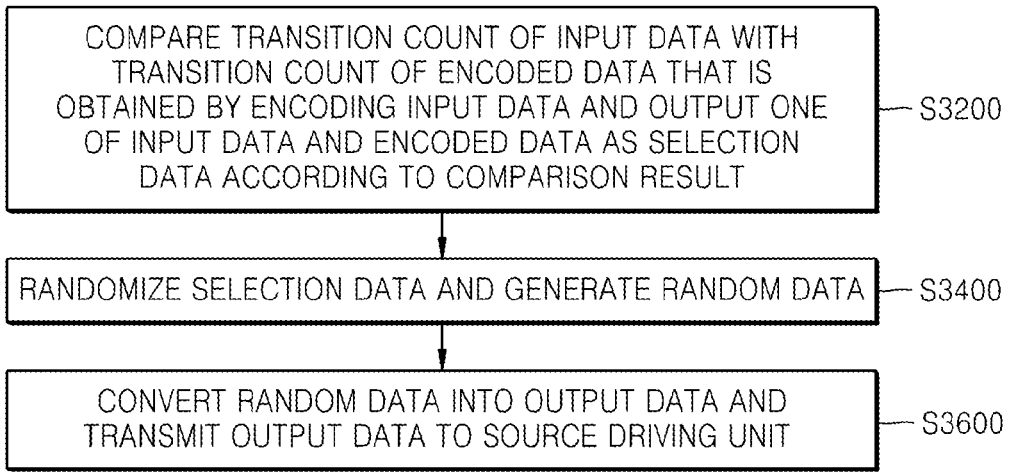
FIG. 30 is a flowchart illustrating a method of operating a display driving integrated circuit, according to an example embodiment of the inventive concepts.

FIG. 30 is a flowchart illustrating a method of operating a display driving integrated circuit, according to an embodiment of the inventive concept. Referring to FIG. 30, the method may include operation S3200 in which one of input data and encoded data may be output as selection data according to a result obtained by comparing a transition count of the input data and a transition count of the encoded data that is obtained by encoding the input data, operation S3400 in which the selection data may be randomized and random data may be output, and operation S3600 in which the random data may be converted into output data and the output data may be transmitted to a source driving unit, as explained above.

According to display driving integrated circuits, display devices, and methods used to perform operations of the display driving integrated circuits of the one or more example embodiments of the inventive concepts, a pattern of data having minimized transition may be used. Thus, power consumption may be reduced and EMI may be attenuated.

According to the display driving integrated circuits, the display devices, and the methods of the one or more example embodiments of the inventive concepts, power consumption and EMI may be reduced, and thus a resolution of the display device may be increased.

According to the display driving integrated circuits, the display devices, and the methods of the one or more example embodiments of the inventive concepts, power consumption may be reduced, thereby improving mobility of the display devices and/or systems including at least one of the display devices.

According to the display driving integrated circuits, the display devices, and the methods of the one or more example embodiments of the inventive concepts, EMI is reduced, thereby improving reliability of the display devices or the systems including at least one of the display devices.

The foregoing is illustrative of example embodiments and is not to be construed as limiting thereof. Although a few example embodiments have been described, those skilled in the art will readily appreciate that many modifications are possible in the example embodiments without materially departing from the novel teachings and advantages of example embodiments. Accordingly, all such modifications are intended to be included within the scope of example embodiments as defined in the claims. In the claims, means-plus-function clauses are intended to cover the structures described herein as performing the recited function and not only structural equivalents but also equivalent structures. Therefore, it is to be understood that the foregoing is illustrative of various example embodiments and is not to be construed as limited to the specific example embodiments disclosed, and that modifications to the disclosed example embodiments, as well as other example embodiments, are intended to be included within the scope of the appended claims.

What is claimed is:

1. A display driving integrated circuit comprising:

a timing controller configured to process input data and output data, the timing controller including, a data selecting unit configured to compare a transition count of the input data with a transition count of encoded data obtained by encoding the input data, and output one of the input data and the encoded data as selection data according to a comparison result;

a data randomizing unit configured to randomize the selection data and generate random data; and a data transmitting unit configured to convert the random data into the output data; and a source driving unit including at least one source driver, the at least one source driver configured to convert the output data received through a transmission channel connected to the timing controller into analog data and output the analog data as display data.

2. The display driving integrated circuit of claim 1, wherein the data selecting unit comprises:

a data input unit configured to receive the input data;

a first transition calculating unit configured to calculate the transition count of the input data as a first value;

a data encoding unit configured to generate the encoded data by encoding the input data;

a second transition calculating unit configured to calculate the transition count of the encoded data as a second value;

a comparison unit configured to compare the first value with the second value and output the comparison result; and a data output unit configured to output one of the input data and the encoded data according to the comparison result.

3. The display driving integrated circuit of claim 2, wherein the data encoding unit is configured to generate the encoded data by encoding first pixel data through Mth pixel data of the input data such that the encoded data includes the first pixel data and differences between adjacent pieces of pixel data from among the first pixel data through the Mth pixel data of the input data.

4. The display driving integrated circuit of claim 2, wherein, the input data includes first pixel data through Mth pixel data, each of the first pixel data through the Mth pixel data of the input data includes first sub-pixel data through Nth sub-pixel data, and the data encoding unit is configured to generate the encoded data by encoding the first sub-pixel data through M*Nth sub-pixel data of the input data, such that the encoded data includes the first sub-pixel data and differences between adjacent pieces of sub-pixel data from among the first sub-pixel data through M*Nth sub-pixel data of the input data.

5. The display driving integrated circuit of claim 2, wherein the first transition calculating unit is configured to calculates the first value by counting a number of 1s in first pixel data of the input data, by counting a number of 1s in values obtained by performing an XOR operation on adjacent pieces of pixel data from among the first pixel data through Mth pixel data of the input data, and by summing the counted numbers of 1s, and the second transition calculating unit is configured to, in response to a first control signal, calculate the second value by counting a number of 1s in first pixel data of the encoded data, by counting a number of 1s in values obtained by performing an XOR operation on adjacent pieces of pixel data from among the first pixel data through Mth pixel data of the encoded data, and by summing the counted number of 1s.

6. The display driving integrated circuit of claim 1, wherein the data randomizing unit comprises:

a scrambler configured to perform an XOR operation on the selection data and a random pattern, and generate the random data; and a pattern generating unit configured to transmit the random pattern to the scrambler.

7. The display driving integrated circuit of claim 6, wherein in response to a second control signal, the pattern generating unit is configured to generate the random pattern in a first cycle corresponding to a size of a horizontal line of a frame of a display panel, which is driven by the display driving integrated circuit.

8. The display driving integrated circuit of claim 6, wherein the source driving unit includes x source drivers, and the random pattern has one logic value corresponding to every 1/x of a size of a horizontal line of a frame of a display panel, which is driven by the display driving integrated circuit.

9. The display driving integrated circuit of claim 6, wherein the data randomizing unit is configured to directly pass the selection data to the data transmitting unit in response to a third control signal, and the data transmitting unit is configured to convert the directly passed selection data into the output data.

10. The display driving integrated circuit of claim 1, wherein the output data includes first mode information indicating the comparison result, and wherein the source driving unit is configured to inversely convert the output data according to the first mode information.

11. The display driving integrated circuit of claim 10, wherein the output data further comprises:

at least one of information about an encoding method performed on the encoded data, information about a cycle of a random pattern of the random data, and information about whether to generate the random data, wherein the source driving unit is configured to inversely convert the output data according to the first mode information and the at least one information.

12. The display driving integrated circuit of claim 1, wherein the data transmitting unit comprises:

a serial converter configured to serialize the random data into serial data; and a data packetizing unit configured to packetize the serial data and generate the output data to the transmission channel.

13. The display driving integrated circuit of claim 12, wherein the source driving unit includes x source drivers, and the data transmitting unit further comprises a clock embedding unit, the clock embedding unit configured to embed a clock signal into the serial data corresponding to every 1/x of a size of a horizontal line of a frame of a display panel, which is driven by the display driving integrated circuit.

14. The display driving integrated circuit of claim 1, wherein the source driving unit includes x source drivers and a plurality of transmission channels including the transmission channel, and the timing controller and each of the x source drivers are connected in a point-to-point manner through the plurality of transmission channels.

15. The display driving integrated circuit of claim 1, wherein the source driving unit comprises x source drivers, and wherein the data selecting unit is configured to generate the encoded data by encoding, using different methods, with respect to at least one portion of the input data corresponding to at least one of the x source drivers and other portions of the input data.

16. A timing controller of a display driving integrated circuit comprising:

a data selecting unit configured to generate selection data from input data and encoded data based on a first transition count of the input data and a second transition count of the encoded data, the encoded data being obtained by encoding the input data, the first transition count being a count of transitions in the input data; the second transition count being a count of transitions in the encoded data; and a data randomizing unit configured to randomize the selection data and generate random data.

17. The timing controller of claim 16, where in the timing controller configured to randomize data having a less transition count from among the input data and the encoded data.

18. The timing controller of claim 16, wherein the data selecting unit comprises:

a first transition calculating unit configured to calculate the first transition count;

a data encoding unit configured to generate the encoded data by encoding the input data;

a second transition calculating unit configured to calculate the second transition count; and a data output unit configured to output one of the input data and the encoded data according to the first and second transition counts.

19. The timing controller of claim 16, wherein the data randomizing unit includes, a pattern generating unit configured to transmit a random pattern, a scrambler configured to perform a logic operation on the selection data and the random pattern received from the pattern generating unit, and generate the random data, a cycle mode selecting unit configured to output mode information indicating a cycle of a random pattern in response to a control signal, and the control signal is configured to set a cycle to select a degree of randomization.

20. The timing controller of claim 16, wherein the data randomizing unit includes, a pattern generating unit configured to transmit a random pattern, a scrambler configured to perform a logic operation on the selection data and the random pattern received from the pattern generating unit, and generate the random data, and a randomizing mode selecting unit configured to, in response to a control signal, output mode information indicating whether to perform the randomizing.

* * * * *